US007138925B2

(12) United States Patent
Nield

(10) Patent No.: US 7,138,925 B2
(45) Date of Patent: Nov. 21, 2006

(54) MICROPROCESSOR INTEGRATED MULTIFUNCTION HOIST SYSTEM CONTROLLER

(76) Inventor: Barry J. Nield, 20 Pinckney St., Greenville, SC (US) 29601

( * ) Notice: Subject to any disclaimer, the term of this patent is extended or adjusted under 35 U.S.C. 154(b) by 210 days.

(21) Appl. No.: 10/911,017

(22) Filed: Aug. 4, 2004

(65) Prior Publication Data

US 2005/0216116 A1 Sep. 29, 2005

Related U.S. Application Data

(60) Provisional application No. 60/557,409, filed on Mar. 29, 2004.

(51) Int. Cl.
*G08B 21/00* (2006.01)

(52) U.S. Cl. ..... 340/685; 701/50; 212/276

(58) Field of Classification Search ..... 340/685; 701/50; 212/276, 278, 279
See application file for complete search history.

(56) References Cited

U.S. PATENT DOCUMENTS 4,178,591 A * 12/1979 Geppert ..... 340/685
4,334,217 A 6/1982 Nield et al.
4,727,447 A * 2/1988 Rome ..... 340/685
4,752,012 A * 6/1988 Juergens ..... 212/278
5,359,516 A * 10/1994 Anderson ..... 701/50
5,557,526 A * 9/1996 Anderson ..... 701/50
5,995,001 A * 11/1999 Wellman et al. ..... 340/438
6,079,576 A * 6/2000 Bosler et al. ..... 212/278
6,382,437 B1 * 5/2002 Okada et al. ..... 212/274
6,744,372 B1 * 6/2004 Shaw et al. ..... 340/685

* cited by examiner

*Primary Examiner*—John Tweel, Jr.
(74) *Attorney, Agent, or Firm*—Sherman D. Pernia

(57) ABSTRACT

The present multi-function cable hoist system controller monitors a variety of drilling rig hoist system functions, including: positioning of the hoist block of the hoist system, speed/momentum of the hoist block, and hoist block loading. The controller can also monitor: cable ton-mile parameters, weight on the drill bit, and drill bit penetration rate. The controller automatically controls operation of the hoist system's drawworks when the system's operation exceeds certain preset and user specified parameters. The controller has a housing containing a microprocessor, supporting circuitry, and input and output systems. An instruction set digitally stored on the microprocessor codes for the functional features of the controller and enables it to process inputs and to generate outputs to accomplish the controller's functions. Device input means and display/alarm means are mounted on the front panel of the housing. A drawworks output communicates drawworks control signals to the hoist system.

14 Claims, 20 Drawing Sheets

Speed/Distance Sensor Input
Device Operational Data Inputs
40
42
Load Sensor
43
40a
42a
43a
70a
Speed Control Function
Position Function
70b
70c
Load Sensor Safety Function
Load Limit Function
70d
Microprocessor
Signal Conditioning Circuits (I/O Ports)
44a
46a
44
62
46
Device Outputs
Drawworks Control Signal Outputs

POSITION FUNCTION - PAGE 1

POSITION FUNCTION - PAGE 2

PUMP PRESSURE CONTROL FUNCTION

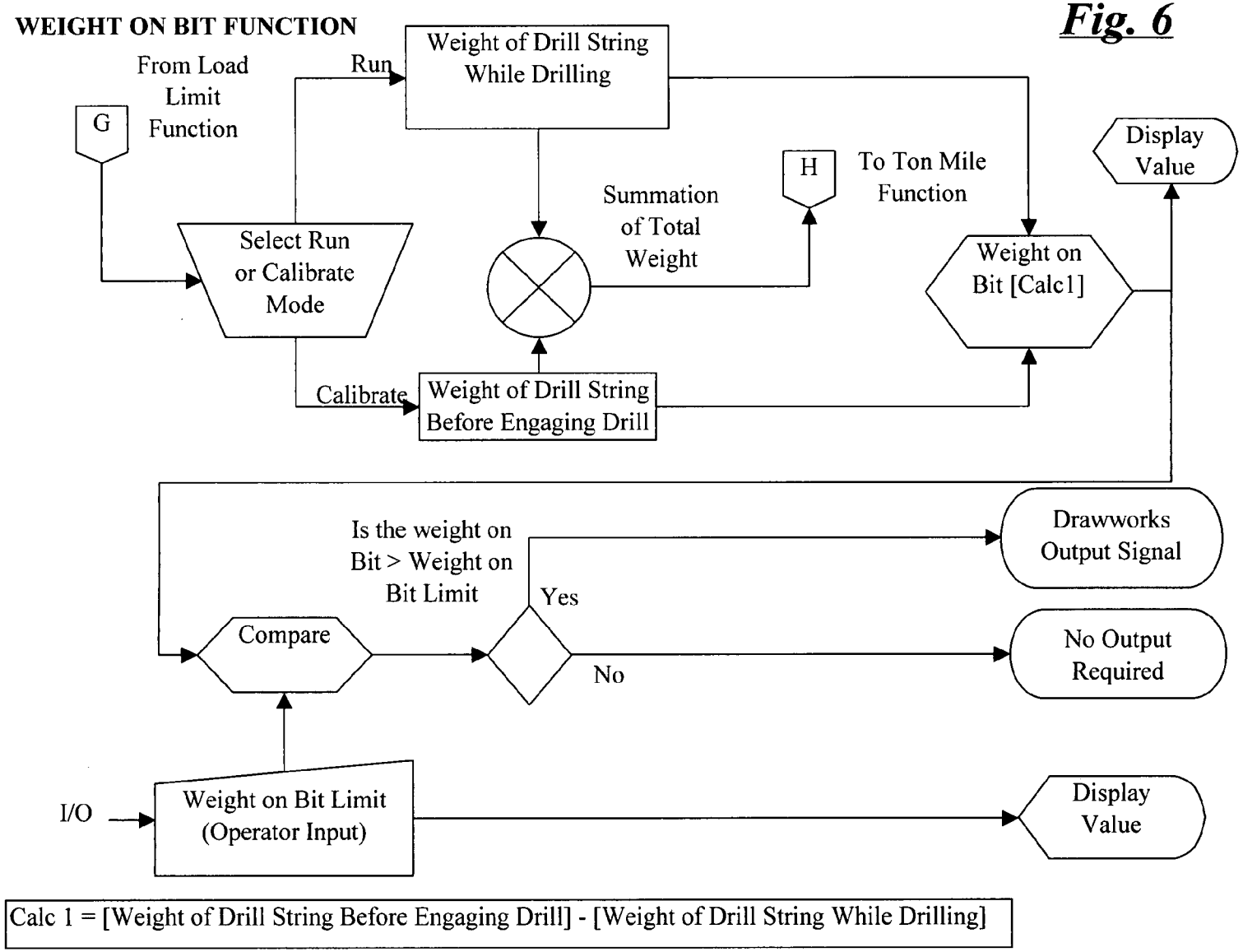
Fig. 6
WEIGHT ON BIT FUNCTION
From Load Limit Function
G
Run
Select Run or Calibrate Mode
Calibrate
Weight of Drill String While Drilling
Weight of Drill String Before Engaging Drill
Summation of Total Weight
H
To Ton Mile Function
Weight on Bit [Calc1]
Display Value
Is the weight on Bit > Weight on Bit Limit
Yes
No
Drawworks Output Signal
No Output Required
Compare
Weight on Bit Limit (Operator Input)
I/O
Display Value
Calc 1 = [Weight of Drill String Before Engaging Drill] - [Weight of Drill String While Drilling]

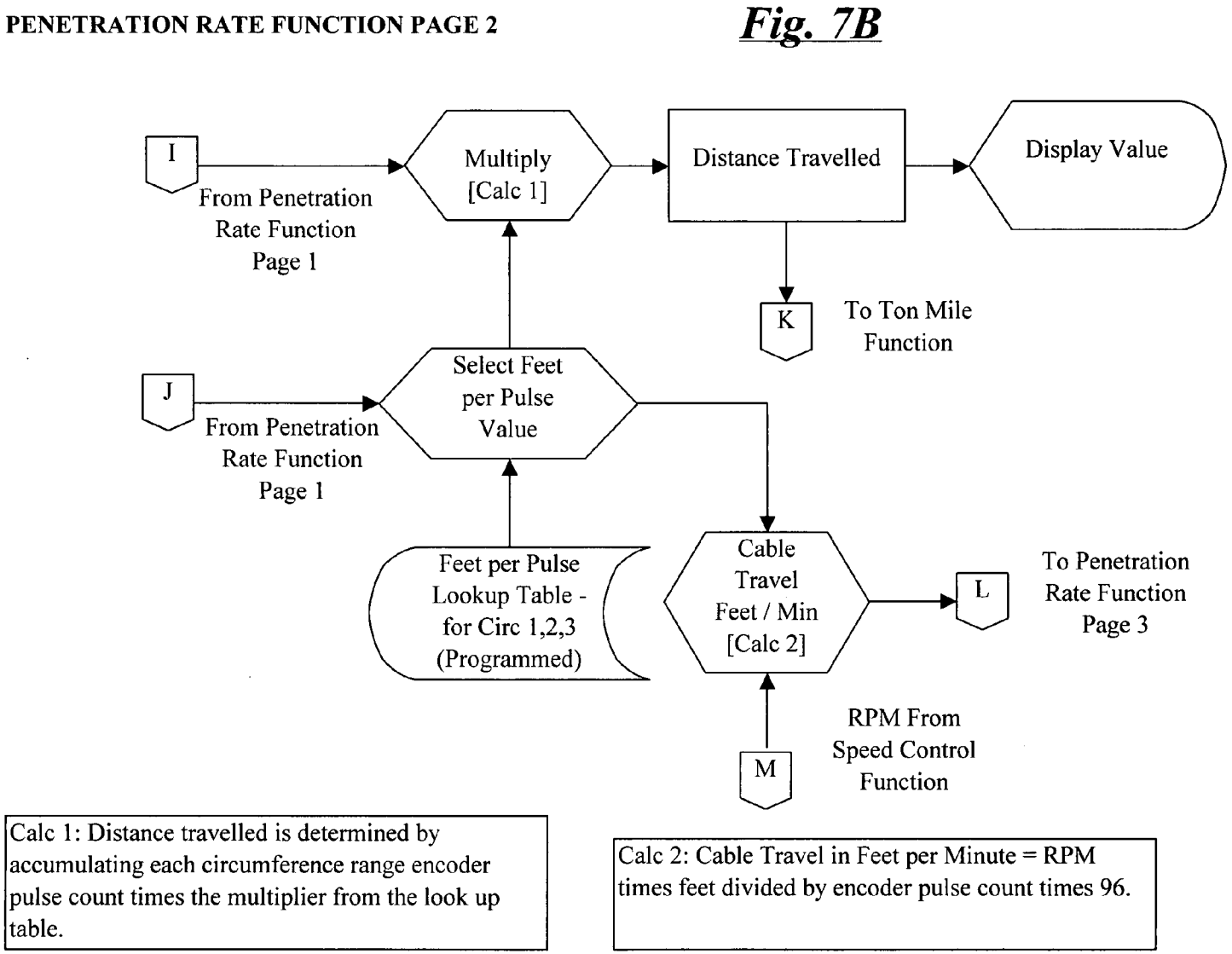
PENETRATION RATE FUNCTION PAGE 2
Fig. 7B
I
From Penetration Rate Function Page 1
Multiply [Calc 1]
Distance Travelled
Display Value
To Ton Mile Function
K
J
From Penetration Rate Function Page 1
Select Feet per Pulse Value
Feet per Pulse Lookup Table - for Circ 1,2,3 (Programmed)
Cable Travel Feet / Min [Calc 2]
M
RPM From Speed Control Function
L
To Penetration Rate Function Page 3
Calc 1: Distance travelled is determined by accumulating each circumference range encoder pulse count times the multiplier from the look up table.
Calc 2: Cable Travel in Feet per Minute = RPM times feet divided by encoder pulse count times 96.

LOGIC DIAGRAM 2

LOGIC DIAGRAM 4

MICROPROCESSOR INTEGRATED MULTIFUNCTION HOIST SYSTEM CONTROLLER

The present application claims the benefit of prior filed U.S. Provisional Application, Ser. No. 60/557,409 filed 29 Mar. 2004, to which the present application is a US national utility patent application.

FIELD OF THE INVENTION

The present invention is in the field of electrical computer based communications. More specifically, the present invention relates to microprocessor controlled circuits and signals responsive to the proximity or distance of an object coming too close to or moving too far from another object, and is useful for setting, controlling and displaying travel limits and ton-mile data of hoist equipment used on cranes, general hoists and drill rigs.

BACKGROUND OF THE INVENTION

In the oil production industry, hoist systems are used for drilling and other operations associated with drilling rigs and well service rigs. These rigs can experience certain conditions that result in the main hoist block of the hoist system traveling into too close proximity of the cable support mechanism at the top of the rig supporting the hoist block and equipment and personnel on the rig's deck. The load block exceeding the upper and lower travel limits can result in damage to the rig or hoist equipment and possible injury to the operating personnel. In response to this risk, the field has been motivated to develop means to set both the upper and lower block travel limits and have a shutdown mechanism to automatically stop movement of the hoist block when either limit is reached.

A variety of shutdown mechanisms have been developed in the field to limit hoist block travel to between set-distance points along its travel path. These include simple electromechanical and optical trip switches operated by the physical movement of the hoist block (or some other part of the hoist system) past the switch, which operates to stop the hoist's drawworks. Problems with such simple trip switch travel limiters further motivated the field to develop more sophisticated shutdown mechanisms. These more sophisticated mechanisms often include indirect means of monitoring the position of the hoist block along its travel path. For example, Nield et al. (U.S. Pat. No. 4,334,217) disclose an electronic controller and indicator that monitors the position of the hoist block along its travel path via a linkage to the drawworks drum of the hoist system rather than to the hoist block.

However, there are conditions inherent in the operation of a hoist system other than the mere location of the hoist (or load) block along its travel limit that are important for the hoist system operator to monitor and control. For example, the momentum of the hoist block as it approaches either its upper or lower travel limit impacts what that limit point should be set at in view of the drawwork's braking capability. With drilling operations capable of attaining depths greater than 15,000 feet, static drill string loads of hundreds of tons can be placed on the hoist block. Movement of such high masses can create an extreme condition of momentum that can cause a travel block to exceed a set-distance type travel limit that it otherwise would not—especially a lower limit.

It would be beneficial to the field to have a hoist block travel controller that set travel limits based on "rate of approach" to a "zero momentum point." This is to say, that the upper and lower limits of the hoist block along its travel path are considered to be points beyond which the hoist block has no momentum ("zero momentum points"), and hence no movement. Therefore, the momentum of the hoist block (the speed and mass of the block including the load it is carrying) and the braking capacity of the drawworks are factored into a function to automatically apply braking to the drawworks at a point within the travel limit of the hoist block depending on the block's mass and rate of approach toward a zero momentum point. Such a shutdown mechanism would permit a maximum travel range to be selected without the same risk of over-travel as in a set-distance type shutdown system.

Another feature of a hoist system that must be monitored, especially in an oil drilling rig, is the ton-mile parameter of the drawworks cable. In a drawworks, the cable wear is influenced by two important factors: the distance traveled by the cable over the sheaves/wheels of the hoist system, and the load supported by the cable. Cable used in such hoist systems has a predetermined life span measured by the product of the number of tons supported times the miles of distance the cable has traveled. This product is designated as the ton-miles parameter of the cable. Exceeding the albeit theoretical ton-mile capacity of a cable can result in failure of the cable with expensive and sometime disastrous results. Also to be avoided is the allowance of too large a safety margin (e.g., caused by an inability to accurately determine the ton-mile wear on a cable), resulting in lost time and added expense when unnecessarily replacing a cable that still has substantial useful life. Therefore, it would be further beneficial to the field to have a multi-function hoist block travel controller that additionally monitored the ton-mile wear parameter of the hoist system's drawworks cable.

SUMMARY OF THE INVENTION

The present invention is a microprocessor integrated multifunction hoist system controller for use with the hoist system, particularly with the hoist system of a drilling or well service rig such as is used in the petroleum production industry. One of the functions of the present hoist system controller is to serve as an automatic hoist block travel limiter. Another function is to serve as a "ton-mile" logger to monitor wear condition of the cable used in the drawworks of the hoist system. The present multifunction, automatic hoist controller is microprocessor controlled. The microprocessor has a I/O system in signal communication with a system of external sensors and detectors, and utilizes the signal from the external sensors and detectors to monitor the condition of the hoist system, particularly the hoist block. The microprocessor receives input signals from the external sensors and detectors via the I/O system and processes the signals according to a digital instruction set. The microprocessor then generates appropriate output signals and sends them via the I/O system to device outputs such as a display and to external outputs such as the drawworks of the hoist system.

The microprocessor is contained within a protective housing. The degree and type of protection the housing is to provide is determined by the environment in which the apparatus is to be used (e.g., weatherproof, hermetically sealed, etc.). Generally, the housing should be suitable for use outdoors and the types of exposure typical for petroleum drilling and service rigs and associated equipment. Mounted on the housing is one or more display devices for presenting pertinent information or data to a user. Also mounted on the housing is one or more manual input means (e.g., key pads, multi-throw switches, etc.) allowing the user to enter data and instruction into the microprocessor. Display devices and manual input means suitable for practice in the present invention are known to and selectable by the ordinary skilled artisan. Preferably, display devices and manual data input means are mounted on the housing under a protective access cover.

A set of instructions specific for the intended use of the present controller is entered into the memory of the microprocessor via the manual data input means (e.g., a keyboard). A general instruction set or software is hard coded into the memory of the microprocessor (e.g., read only memory). On site, an application specific instruction set is entered and stored on the microprocessor. The application specific instruction set can be entered at the device itself (via input means mounted on the device), or optionally, may be supplied to the microprocessor from an external data source. The instruction set enables the microprocessor to process signals received from the external sensor system and to generate outputs to accomplish the automatic travel limiting control of the drawworks.

BRIEF DESCRIPTION OF THE DRAWINGS

FIG. 6 is a block decision flow diagram exemplifying the Weight-on-Bit function of the present hoist travel limiter.

FIGS. 7A to 7C are decision flow block diagrams exemplifying the Penetration Rate function of the present hoist travel limiter.

DETAILED DESCRIPTION OF THE INVENTION

Figure 1:
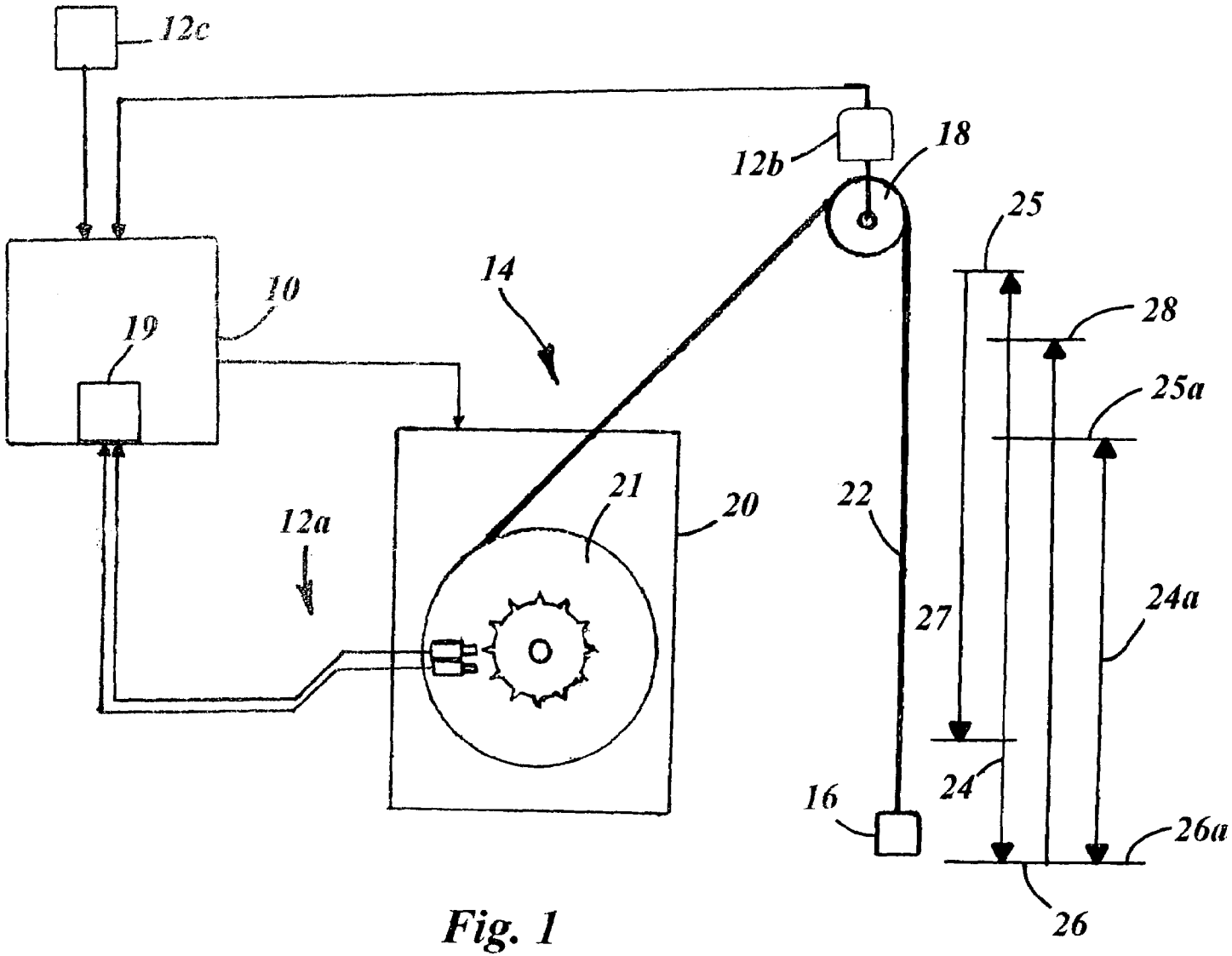
FIG. 1 is a schematic diagram of a typical hoist system showing the present travel limit controller in communication with the drawworks of the hoist system.

Referring now to the drawings, the details of preferred embodiments of the present invention are graphically and schematically illustrated. Like elements in the drawings are represented by like numbers, and any similar elements are represented by like numbers with a different lower case letter suffix.

Figure 2:
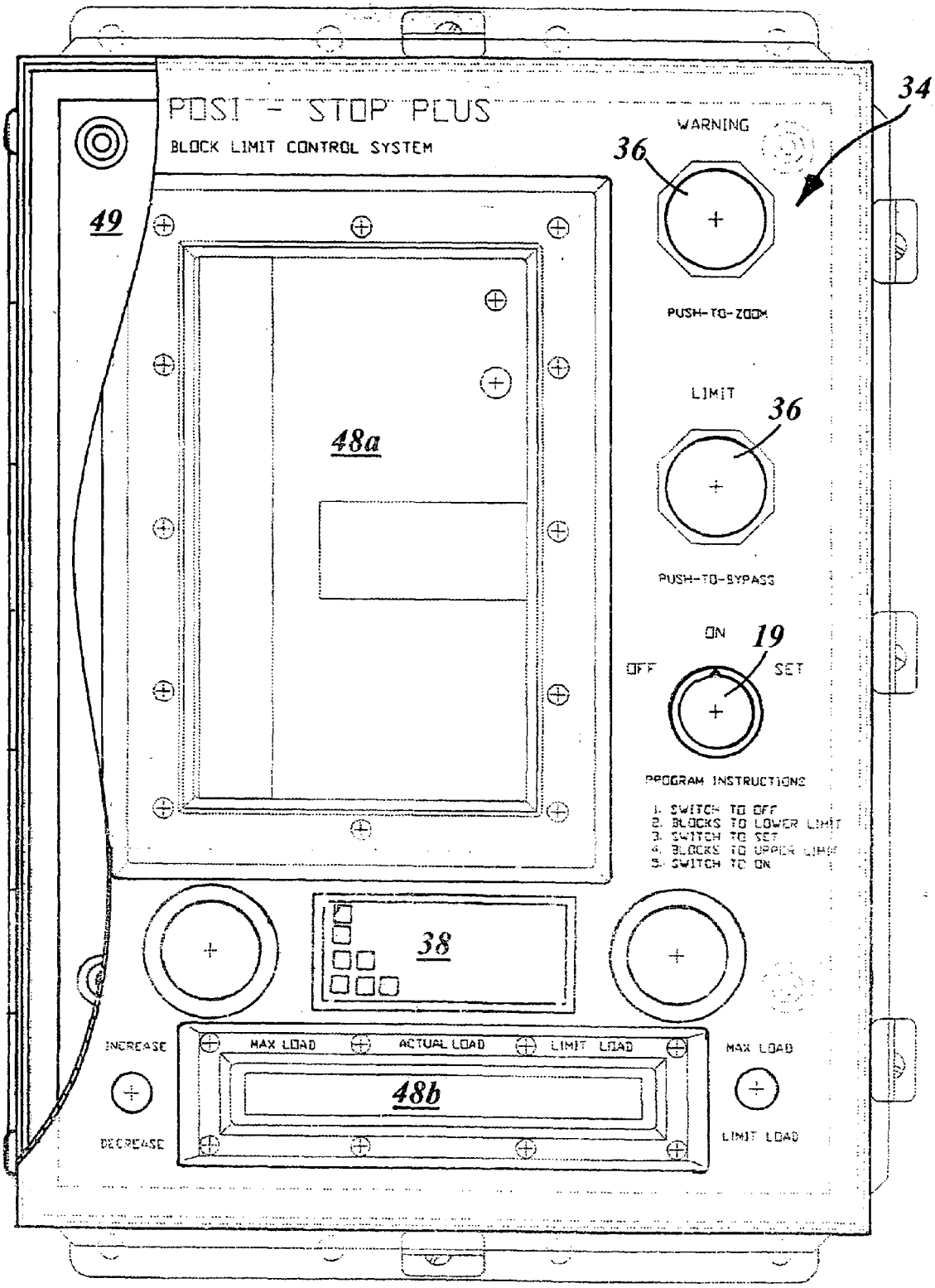
FIG. 2 is a drawing of an embodiment of the present computer controlled hoist travel limiter illustrating its small (relative to the hoist equipment it controls) and self-contained features.

The present invention, an embodiment of which is illustrated in FIG. 1, is a multi-function cable hoist system controller 10. The present cable hoist system 10 is intended for use in combination with a heavy hoist system 14 such as is used in the petroleum production industry on drilling and servicing rigs. As disclosed herein, the present hoist system controller 10 can accomplish a plurality of functions relating to limiting the (ravel of the hoist block 16 of a heavy cable hoist system 14. These travel limit functions include monitoring the speed of the traveling block 16, as well as limiting the travel range of the block 16 to avoid its approach too close to the stationary block 18 or too close to the rig deck (not shown). Additionally, the present hoist controller 10 functions as a ton-mile logger for monitoring wear on the cable 22 of the drawworks 20. Preferably, the present hoist system controller 10 is a relatively small and self contained unit (see FIG. 2), mountable proximate the hoist system 14 with which it communicates.

The hoist system controllers 10, in combination with appropriate system of external sensors and detectors 12, is responsive to the proximity or distance of the moving hoist block 16 to another object relative to its location within its travel limit 24. In the simplified schematic example illustrated in FIG. 1, the load block or hoist hook 16 of a hoist system 14 is limited to a travel range 24 between an upper limit 25 and a lower limit 26. Such hoist equipment 14 typically comprises a load carrying means (e.g., a load hook suspended under a hoist/travel block) 16 which may be susceptible to being raised or lowered beyond a desired travel range 24 and too close to another object. The present hoist system controller 10 controls the drawworks 20 of the hoist equipment 14 to automatically prevent over-travel of the equipment's load hook 16 beyond the desired travel range 24 to within a distance too close to another object, e.g., the stationary block 18.

Figure 3:
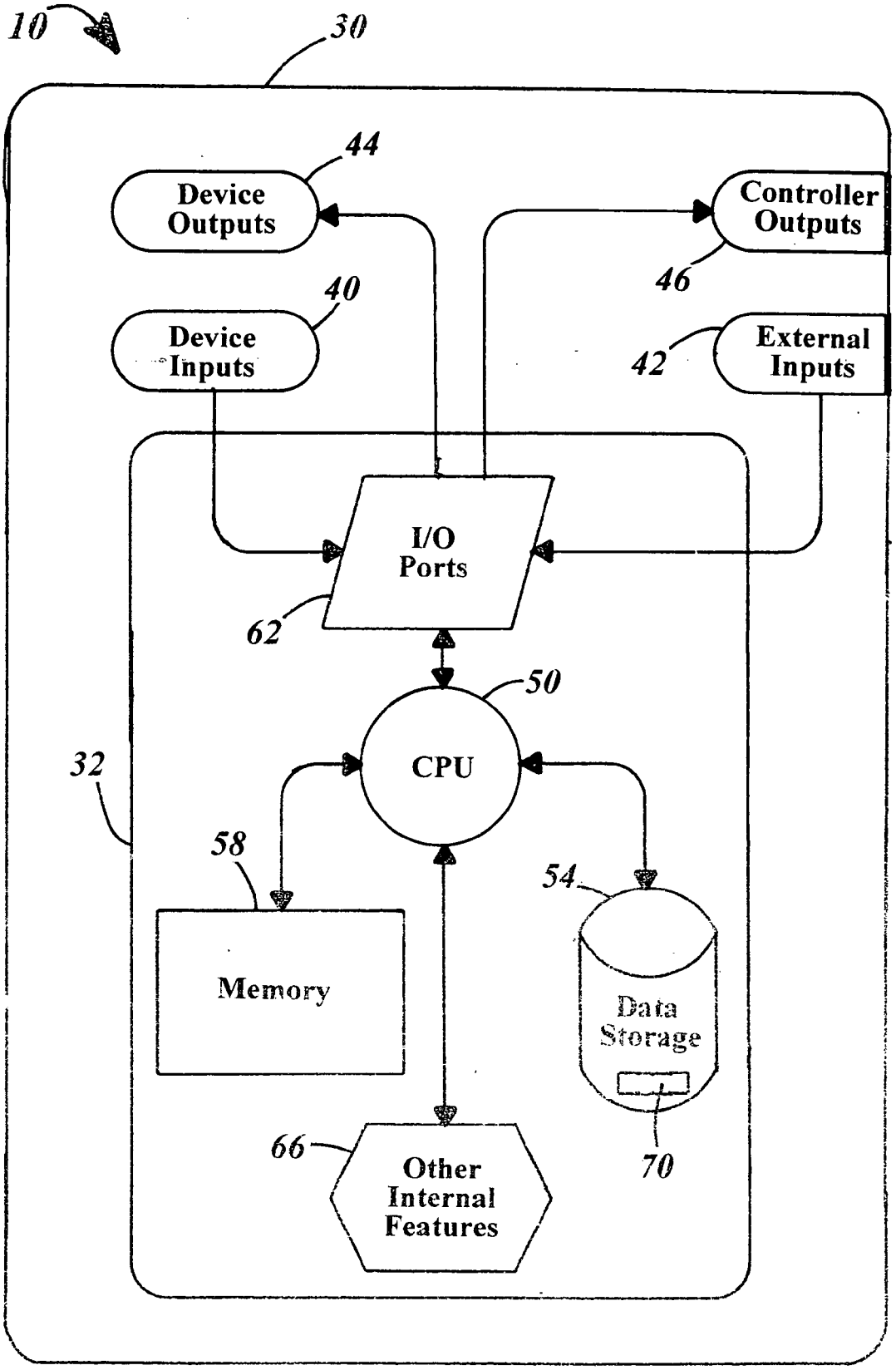
FIG. 3 is a schematic block diagram of the present computer controlled automatic hoist travel limiter.

As illustrated in FIG. 3, the multi-function cable hoist system controller 10 comprising a housing 30, a microprocessor 32, device inputs and outputs 40 & 44, and external inputs and outputs 42 & 46. In the preferred embodiment illustrated in FIG. 2, a housing 30 contained the microprocessor 32. The device inputs 40 and outputs 44 were mounted on the front panel 34 (see FIG. 2) of the housing 30 to present operational controls 19 & 36, device data and instruction input means 38, and data displays 48*a* & 48*b* to the user. In the preferred embodiment shown in FIG. 2, a hinged access cover 49 was provided to protect the features mounted on the front panel 34 of the housing 30. External inputs 42 and outputs 46 are typical electrical/electronic connectors and can be mounted anywhere on the housing 30 that is appropriate for an intended application. In the embodiment illustrated in FIG. 2, the displays were in the form of a liquid crystal panel display 48*a* and an LED digital display 48*b*. Other types of displays are practicable in the present invention by the ordinary skilled artisan. These include flat screen CRT displays. Display and alarm/notice output signals 44 were provided by the microprocessor 32 via an I/O port 62.

The microprocessor 32 includes a CPU 50, data storage means 54, memory 58, I/O ports 62, and other internal features 66 typical of microprocessors (see FIG. 3). The instruction set 70 is digitally stored in the data storage 54 of the microprocessor 32. The instruction set 70 enables the microprocessor 32 to process input signals from the device inputs 40 and external inputs 42, and to generate and send output signals to the device outputs 44 and the external controller outputs 46 to accomplish the functions of the present controller 10.

A system of external detectors and sensors 12 are in signal communication with the I/O ports 62 of the microprocessor 32 via the external signal input system 42. The external signal input system 42 receives signals from the external detectors and sensors 12. A device input system 40 is mounted on the housing 30 and is in communication with the I/O ports 62 of the microprocessor 32. The device input system 40 provides for transmitting data and instructions entered via input devices 36 & 38 (e.g., switches and keyboard) mounted on the front panel 34 of the present device 10 to the microprocessor 32.

A device output system 44 is in communication with the I/O ports 62 of the microprocessor 32. The device output system 44 transmits device related output signals from the microprocessor 32 to the output (e.g., display) devices 48 mounted on the front panel 34 of the hoist system controller 10. An external (controller) output signal system 46 is also in communication with the I/O ports 62 of the microprocessor 32. The external signal output system 46 communicates control signals generated by the microprocessor 32 to the hoist system 14, and specifically to the drawworks 20. These control signals regulate the operation of the drawworks 20. The present hoist system controller 10 also had the capability to override or shut-off the automatic limit control features of the microprocessor 32 to allow a user to move the traveling block 16 below or above the travel range 24, if required.

The hoist system controller 10 includes circuits and signal inputs & outputs for setting, controlling and displaying travel limit functions related to the operation of hoist equipment used on cranes, general hoists and drill rigs. More specifically, the present hoist travel limiter 10 includes a microprocessor circuit 32 communicating with certain peripheral input/output (I/O) features, all contained within a housing 30. A software instruction set 70 provides the necessary instructions to the microprocessor 32 to accomplish its functions. Appropriate power sources (not shown) for providing electrical power to the various electrical circuits are known in the art and selectable by the ordinary skilled artisan for practice in the present invention. An appropriate power source circuit may be housed entirely within the housing 30 (e.g., a battery power supply), may be supplied from an external power source (e.g., a power cord), or may be some combination of the two (e.g., a rechargeable internal power source circuit).

Microprocessors 32 suitable for practice in the present hoist controller 10 are known to and selectable by one of ordinary skill in the art in view of the teachings and illustrations contained herein. The selection criteria for an appropriate microprocessor 32 is based on applicability of the instruction set for the desired end use. In addition, the microprocessor must have enough I/O capability to provide the interface for the hardware to be used. The capacity of data storage 54 capacity needs to be large enough to contain the instruction set, with a concomitant capacity for memory 58. Preferably, the features of the microprocessor 32 include operating characteristics compatible with the potential range of extreme environmental conditions under which the hoist system controller 10 may be required to operate. As an example, in the preferred embodiment illustrated, the operational temperature range of the microprocessor 32 was on the order of −40° F. to +135° F., and was vibration and shock tolerant. An example of a microprocessor 32 that was useful in the present hoist system controller 10 is the Intel series 8515 microprocessor. Other semiconductor devices that may be practiced in the present invention as the microprocessor 32 are available from Texas Instruments, Motorola and Atmel. Some of the alternative components do not have Eeprom available on the microprocessor device to store the programmed variables, but have the ability to write and read this information from a separate Eeprom device.

The microprocessor 32 receives and processes signals and data from external sensors and other inputs. In the preferred embodiment illustrated in FIG. 1, the microprocessor 32 received signals from an external sensor system 12*a* that conveyed block travel information derived from the rotational condition of the drawworks 20. Other external sensor signals conveyed to the microprocessor 32 included load information derived from a load cell sensor 12*b*. Other inputs into the microprocessor 32 include data derived from the device inputs 40 of the hoist controller 10 itself(see front panel of embodiment in FIG. 2). The microprocessor 32 was preprogramed with a general set of instructions appropriate to an intended application of the controller 10, and receive specific instructions via the device inputs 40 mounted on its control panel 34. Alternatively, the microprocessor may be provided with another input means such as a serial port or a USB port and receive its instructions via a device connected to such port. In the preferred embodiment, the output of the microprocessor was used to drive the displays 48*a* & 48*b* and other indicators (e.g., alarms) of the travel limiter 10. Additionally, the I/O port outputs can be used to drive other peripheral devices such as a printer or to export data, e.g., via an ethernet card.

Figure 4A:
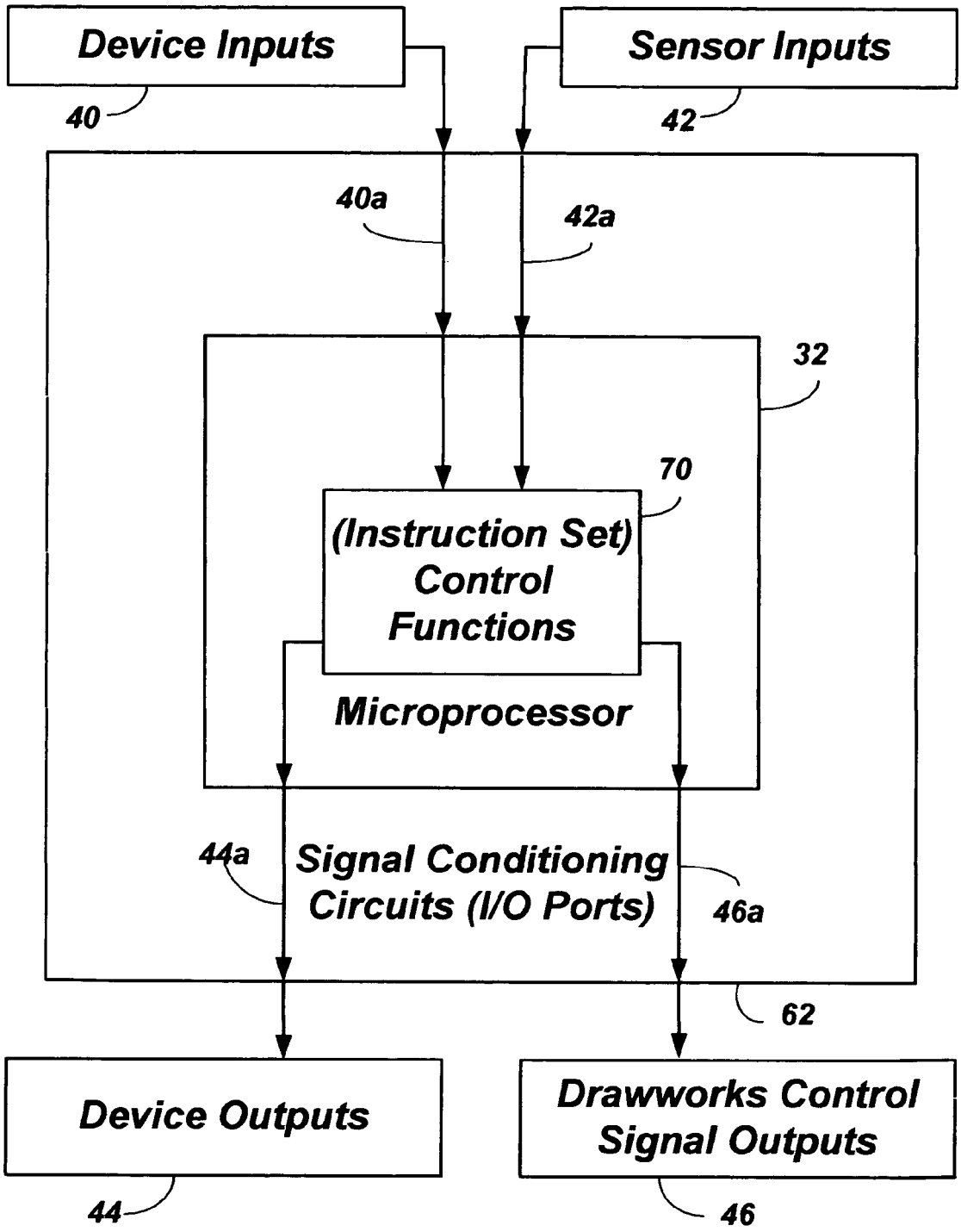
FIG. 4A is a simplified block diagram of the general relationship between features of an exemplary embodiment of the present microprocessor integrated multifunction hoist system controller.
Figure 4B:
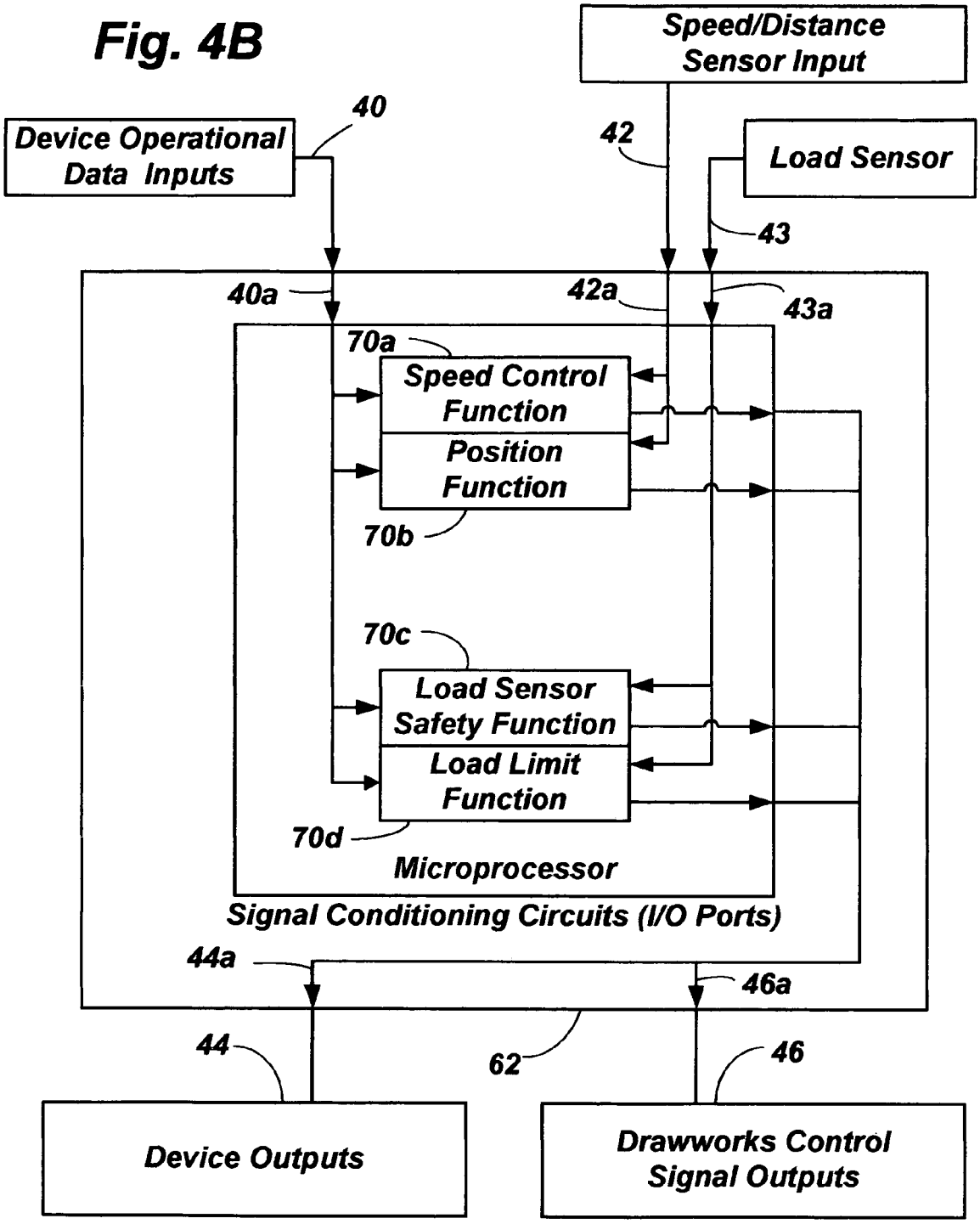
FIG. 4B is a block diagram of the relationship between features of a preferred embodiment of the present hoist system controller showing a set of control functions.

FIG. 4A is a representation of the general relationship between features of an exemplary embodiment of the present microprocessor integrated multifunction hoist system controller. Generally, one or more device input means 36 & 38 is used to enter application specific data instructions inputs 40 into the microprocessor 32 at the start of hoist operations. During operations, external sensor and detector inputs 42 are sent to the microprocessor 32 for processing. If necessary, the inputs 40 & 42 are processed by an I/O port conditioning circuit 62 (e.g., an A to D converter) to produce conditioned inputs 40*a* & 42*a* matched to the microprocessor's input requirements. Inputs to the microprocessor 32 are processed according to the appropriate instruction set control function 70. If the control function 70 generates an output signal, the output signal is processed as necessary by the I/O port 62 to produce conditioned outputs matched to signal requirements of the target output device or system. Two types of output signals are generated: device output signals 44 which are sent to a display means 48 on the hoist controller's front panel 34; and drawworks control signal outputs 46, which serve to control operation of the hoist system 14 and are sent to the drawworks 20. FIG. 4B is a more detailed representation of the relationship between features of a preferred embodiment of the present hoist system controller 10 showing a specific set of control functions sufficient to accomplish speed/momentum control and travel limit control in a hoist system.

Figure 5A:
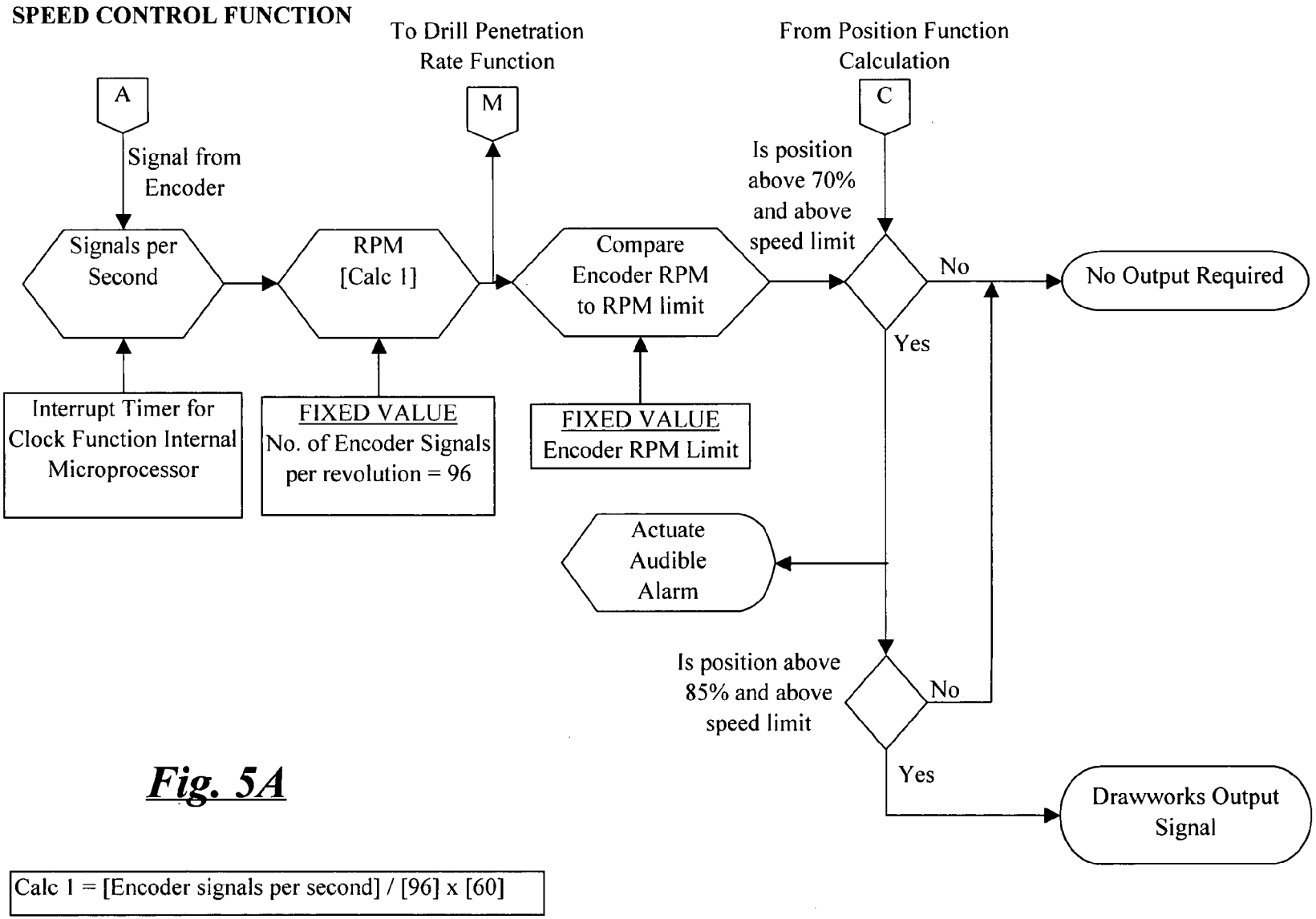
FIGS. 5A to 5F together are decision flow diagrams exemplifying the operational functions of a preferred embodiment of the present microprocessor controlled automatic hoist travel limiter.
Figure 5B:
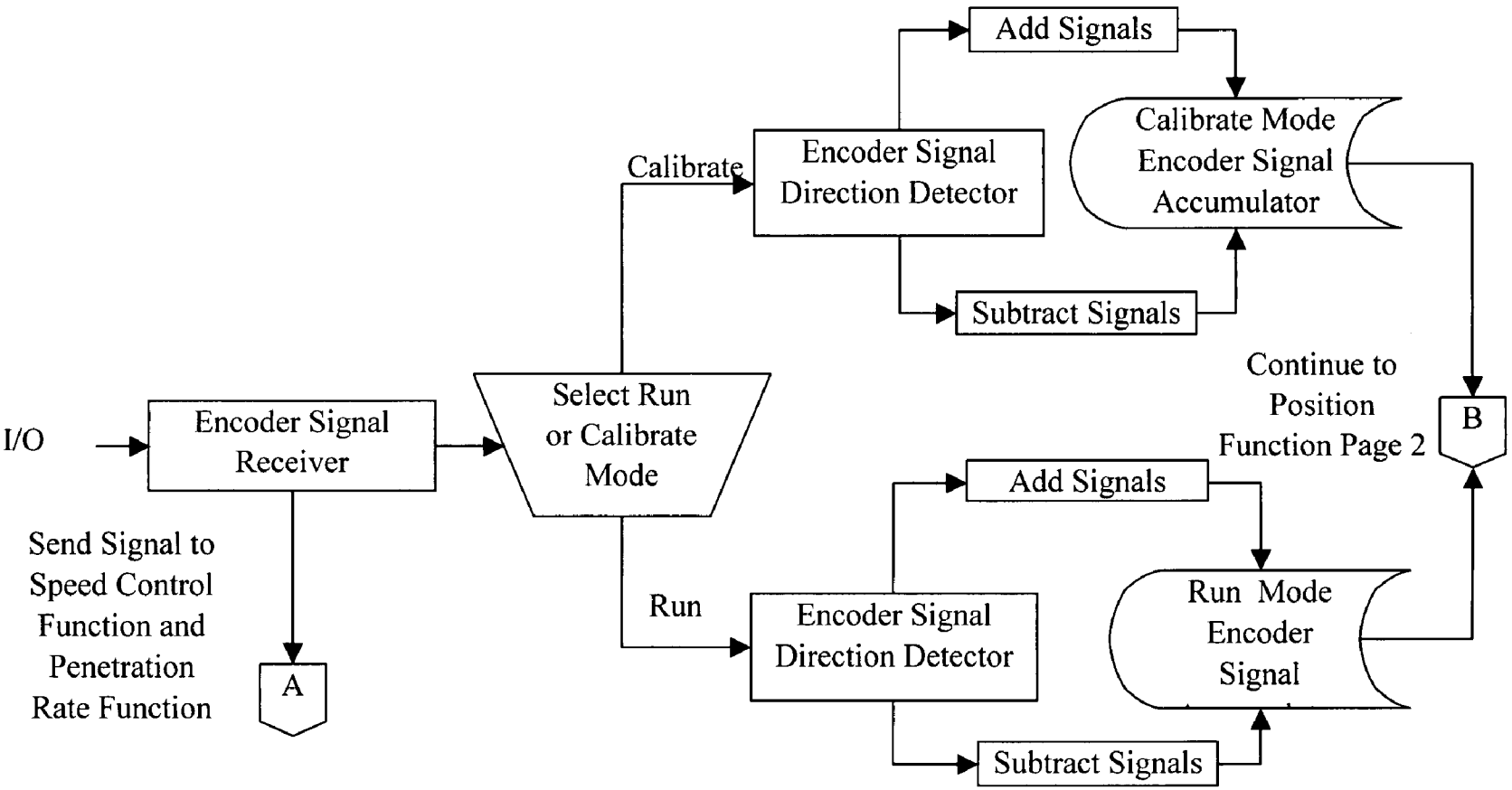
Figure 5C:
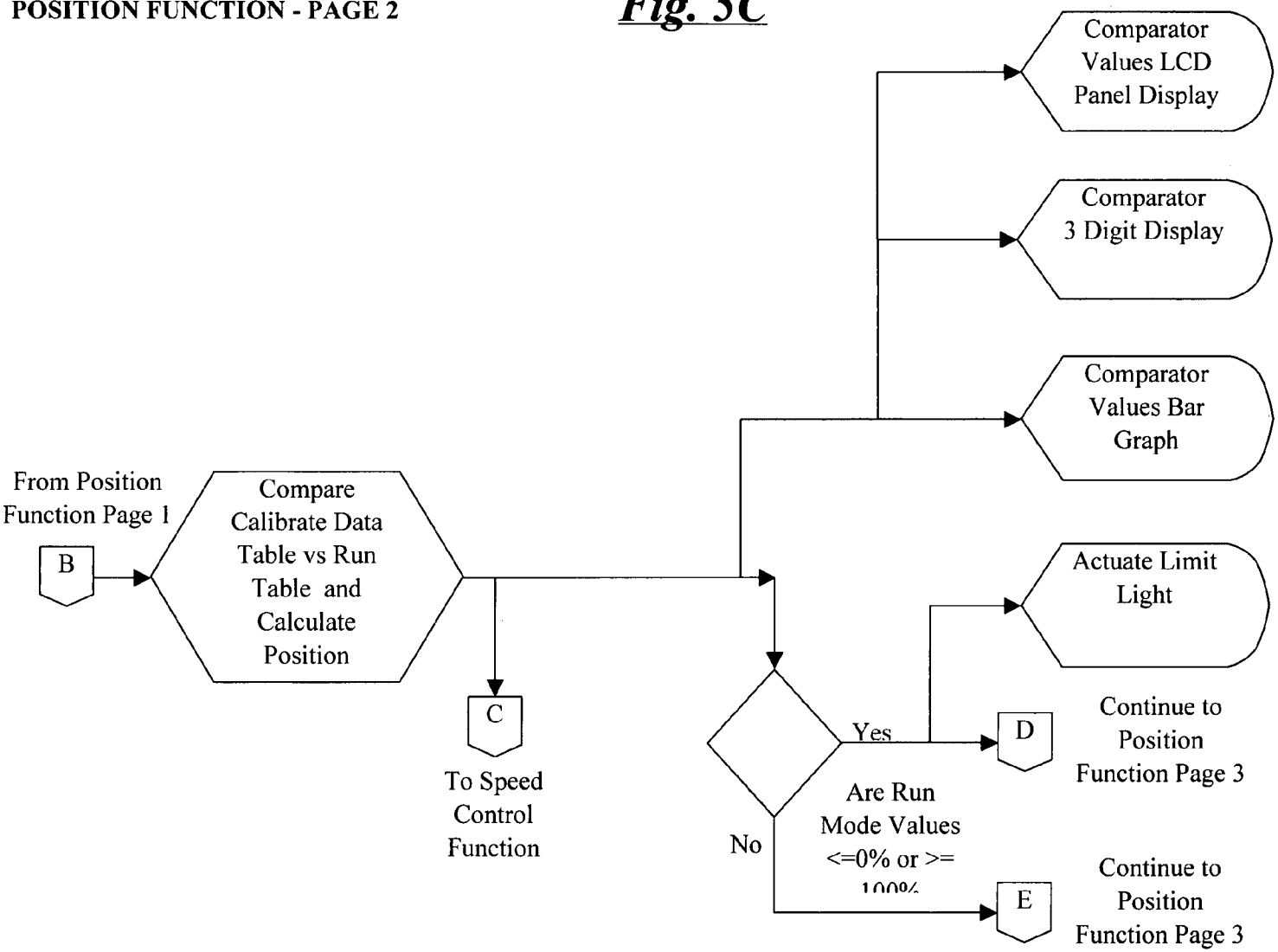
Figure 5D:
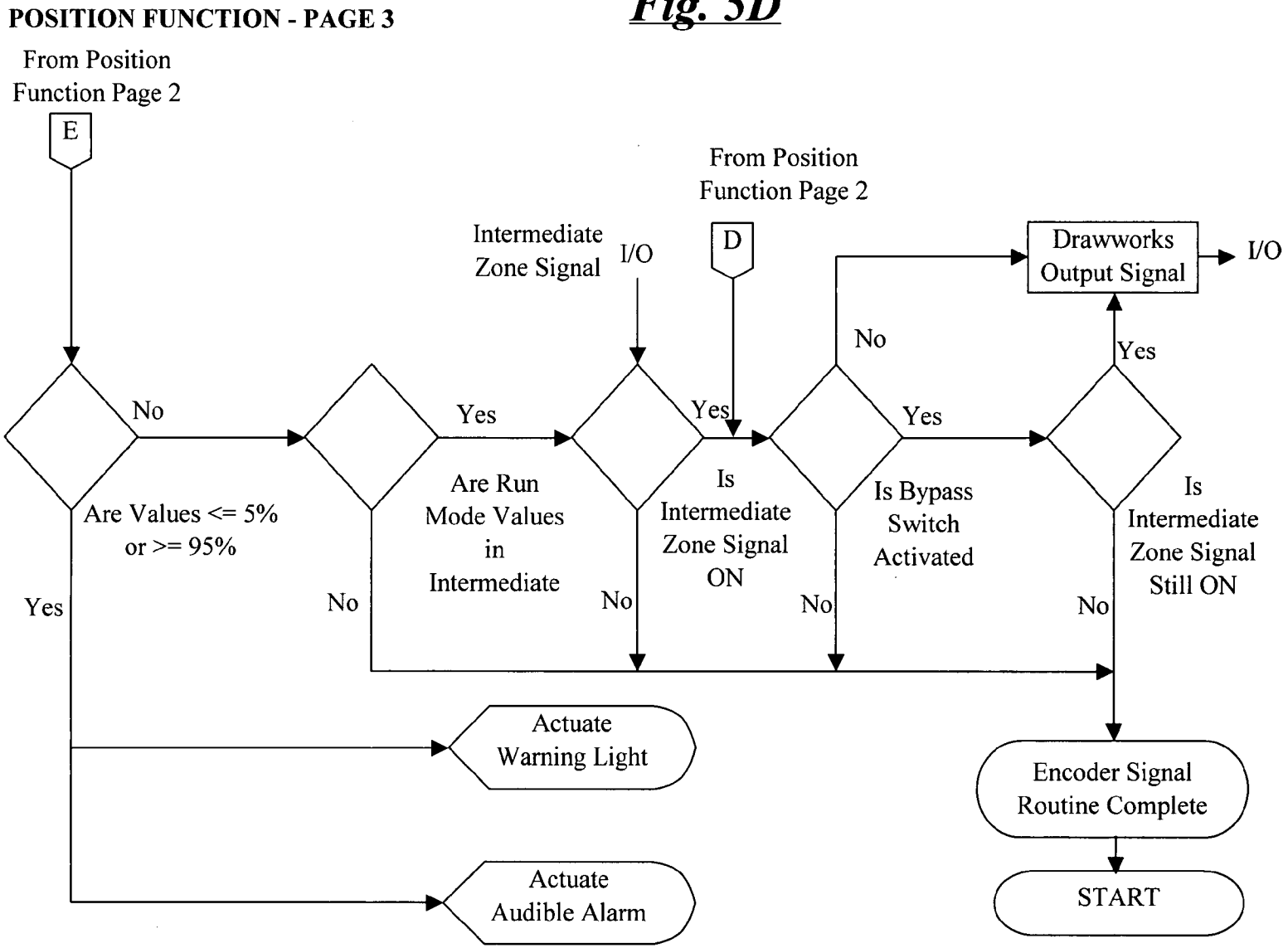
Figure 7A:
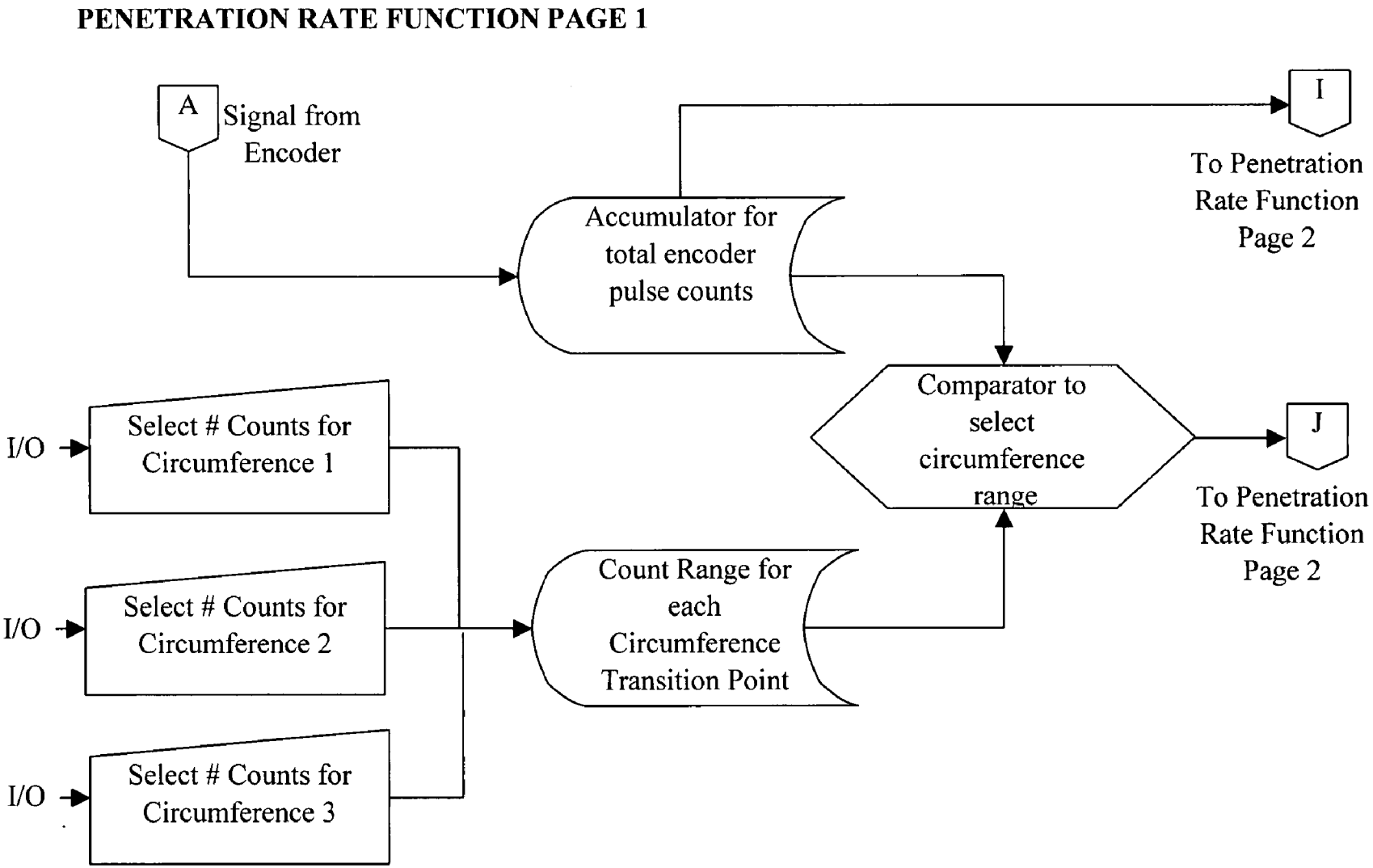
Figure 7C:
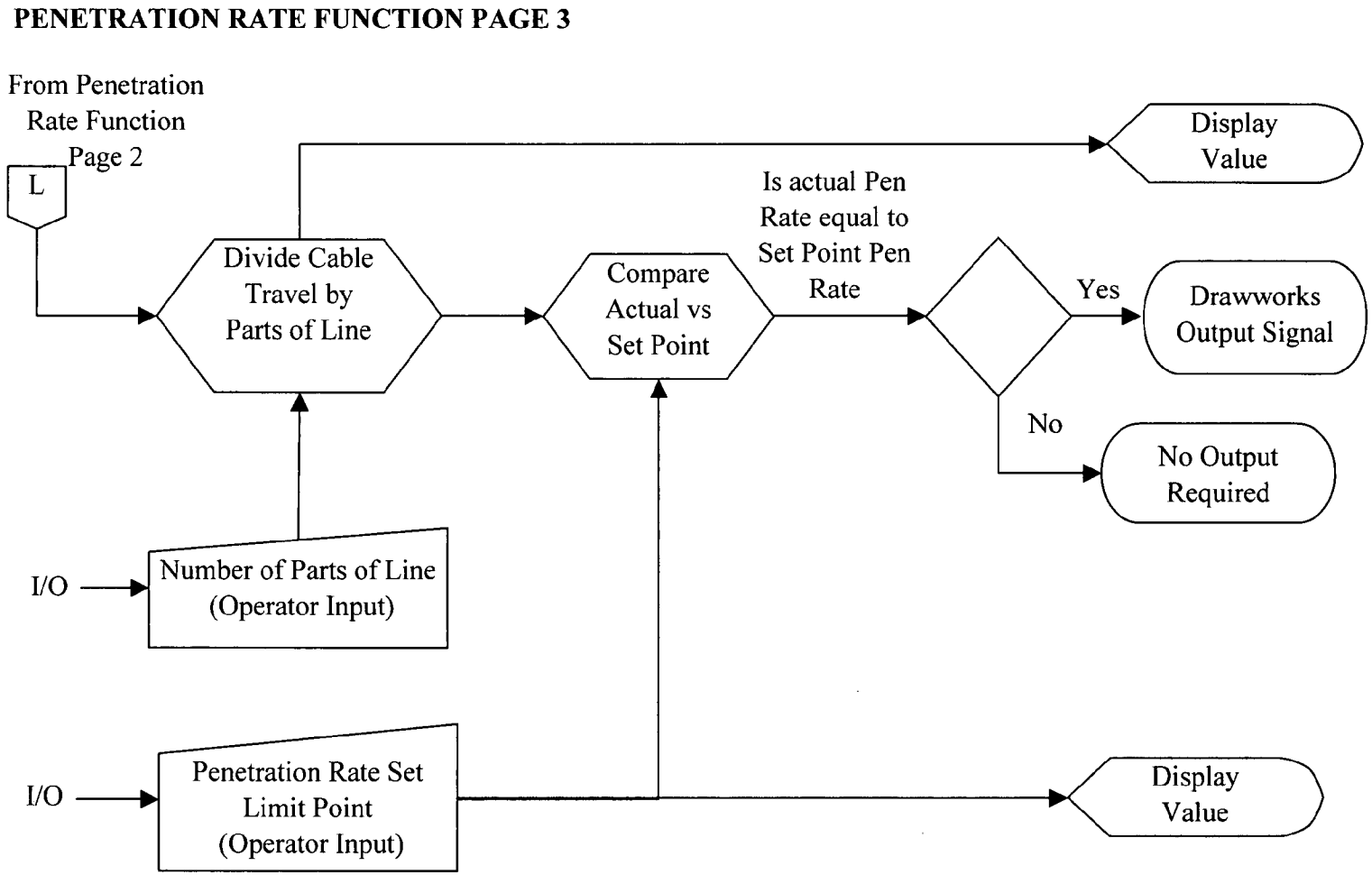
Figure 8:
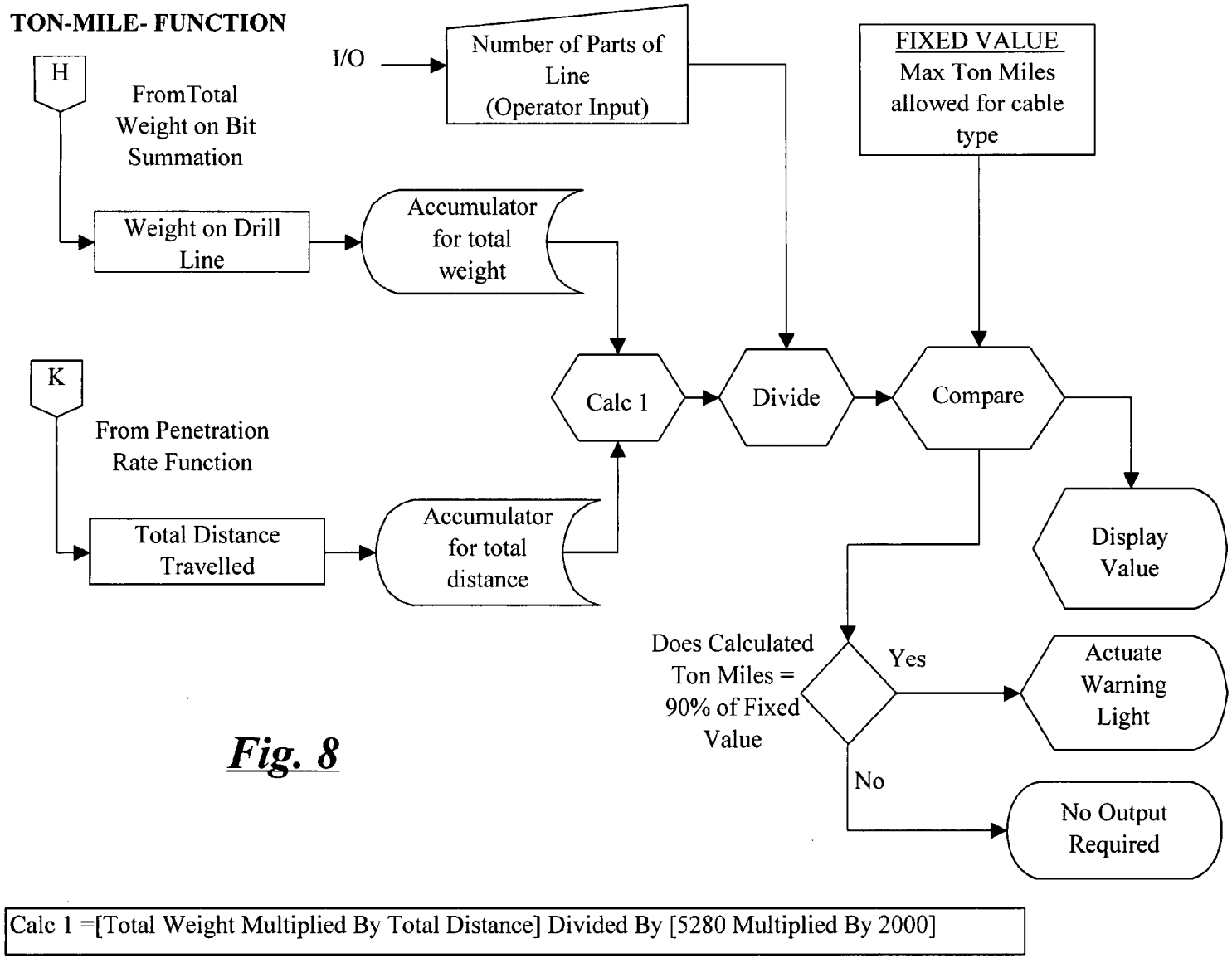
FIG. 8 is a block decision flow diagram exemplifying the Ton-Mile function of the present hoist travel limiter.
Figure 9A:
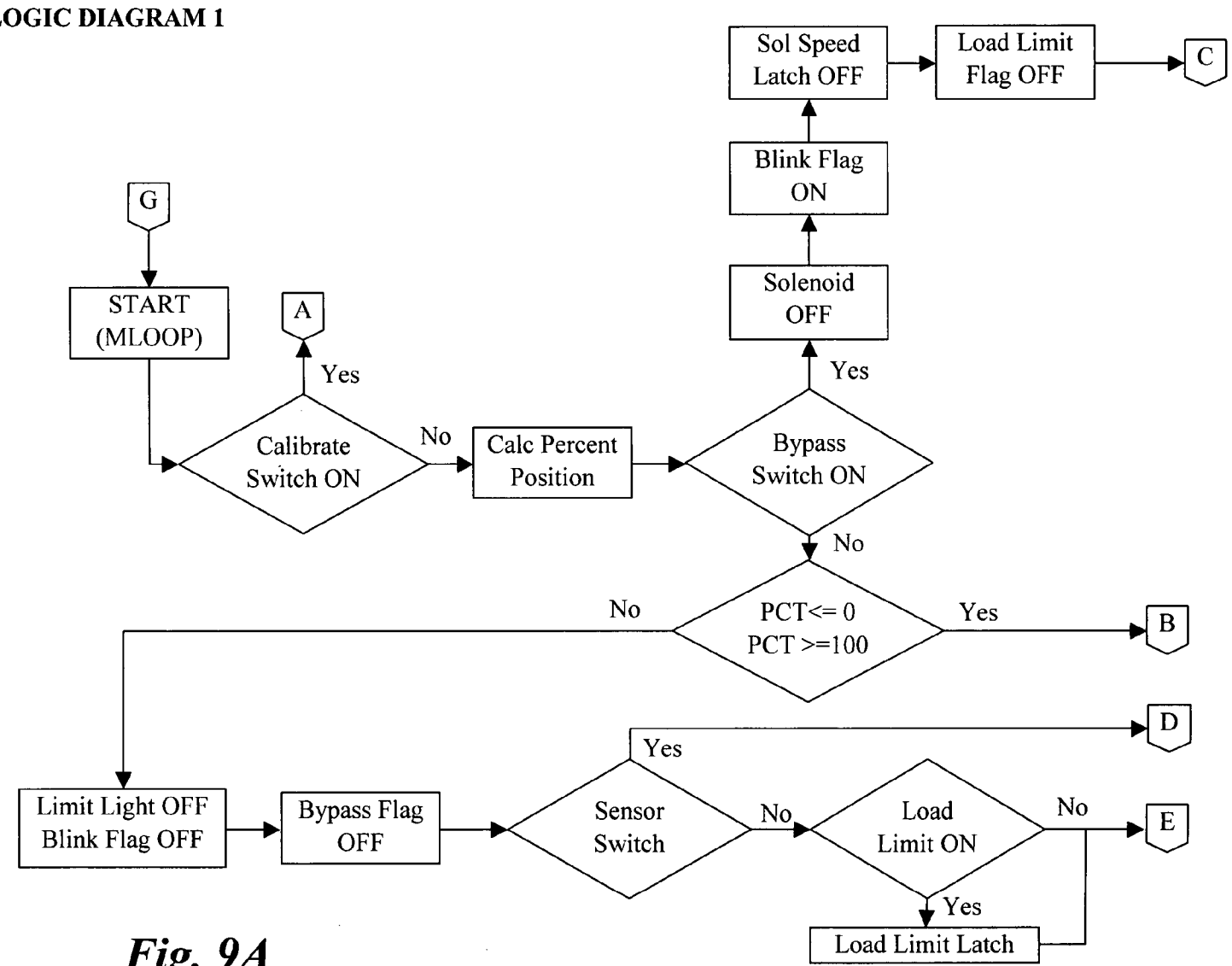
FIGS. 9A to 9D are block diagrams of the overall operational logic flow of the present hoist travel limiter.
Figure 9B:
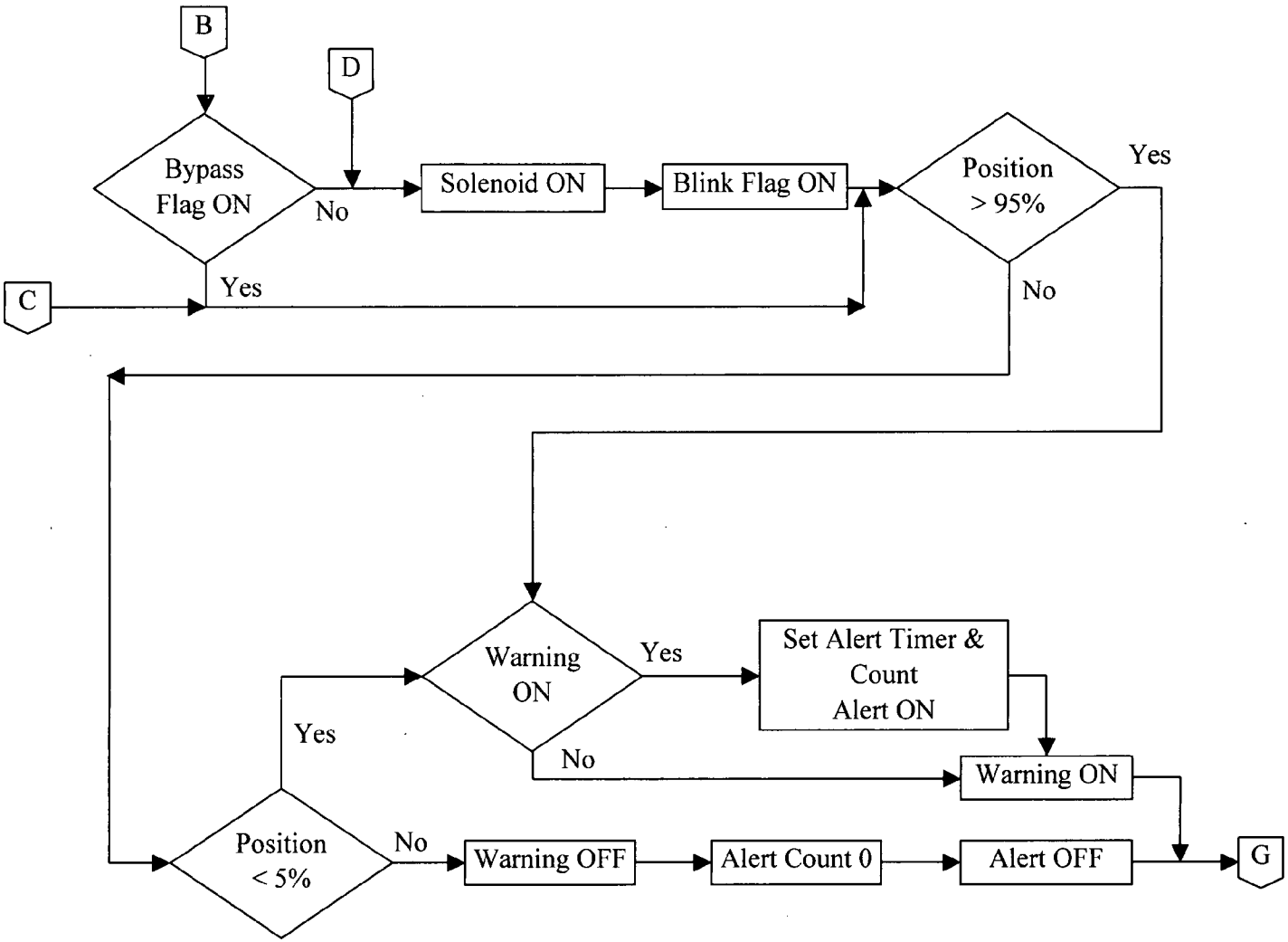
Figure 9C:
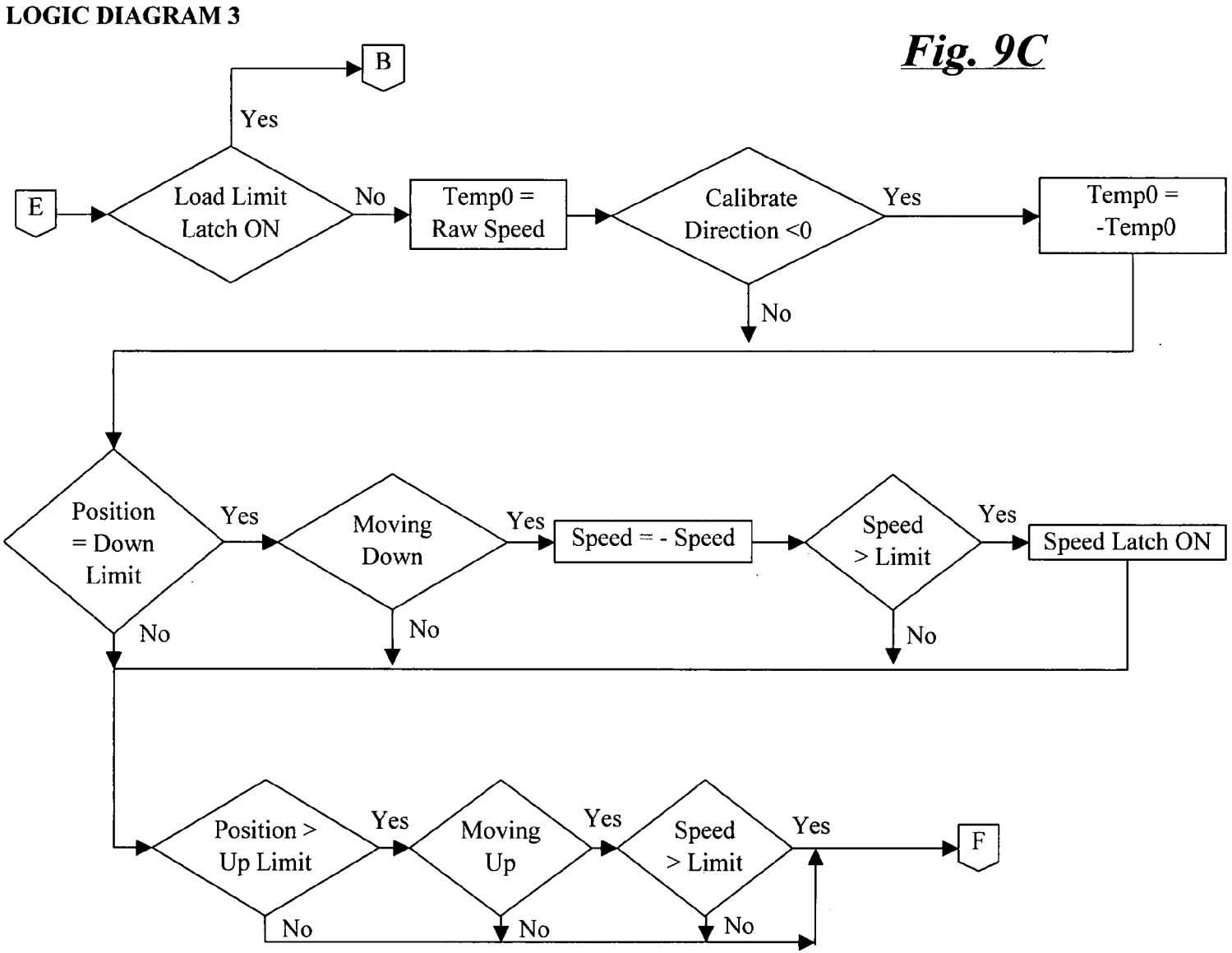
Figure 9D:
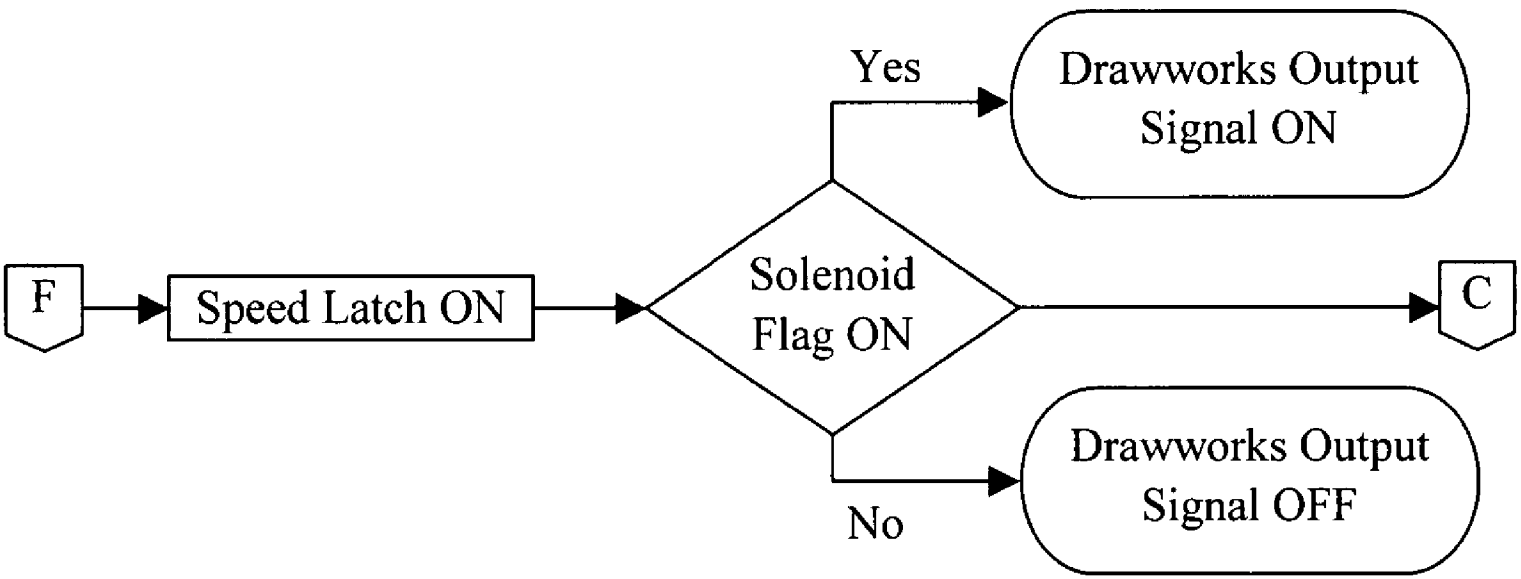

In the preferred embodiment of FIG. 4B, the instruction set 70 comprised a speed control function 70*a* (see FIG. 5A) for determining the rate of vertical displacement of the hoist block 16 along its travel range 24; a position control function 70*b* (see FIGS. 5B to 5C) for determining the position of the hoist block 16 of the hoist system 14 within the travel range 24; and load limit and load sensor safety functions 70*c* and 70*d* (see FIGS. 5E and 5F) for determining an instantaneous mass of a load on the hoist block 16 and protecting the related hydraulics. Optionally, other cable hoist system functions may be practiced in the present hoist system controller 10. These other functions include: a weight-on-bit function (see FIG. 6) for monitoring the downward force on a drill bit suspended downhole from the hoist system; a penetration rate function (see FIGS. 7A to 7C) for monitoring the downward movement of the hoist block during drilling; and a ton-mile function (see FIG. 8) for monitoring cable wear of the hoist system 14.

Sensors and Detectors

In the preferred embodiment illustrated in FIG. 1, the present hoist system controller 10 utilized only two externally derived input signals: a speed/positional signal and a load signal. The speed/positional signals were provided by an optical encoder type external sensor system 12*a* coupled to the drawworks 20 of the hoist system 14. The optical sensor system 12*a* provided electronic signal pulses relating the rotation of the cable drum 21 on the drawworks 20 to the relative position of the traveling block 16. However, the optical sensor system 12*a* could be any other type sensor/detector mechanism that produces an electronic signal useful for relating drawworks rotation to position of the traveling block 16. The load signal was provided by a hydraulic pressure-sensing device or load sensor 12. The load sensor 12 produced an electronic signal relating the instantaneous pressure imparted by the weight load on the drawworks stationary block 18.

Position Function Features

The signal produced by the rotation-sensing system 12*a* was received by the microprocessor 32 as a two-channel signal (see FIG. 1). This two-channel signal enabled the instruction set/software in the microprocessor 32 to determine travel direction (up or down) of the hoist block 16 (see FIG. 5B–5D). The operation switch 19 communicated with calibration feature of the instruction set 70 position function 70*b*. Selection of the calibrate feature of the operation/mode switch 19 signaled the processor 32 that the incoming position signals were to be used to calibrate the travel limit 24 of the load block 16. Because of the design of the rotation sensor 12*a*, the direction of rotation of the drawworks 20 was indicated by which signal channel sent the "first" pulse signal of a pair of signal pulses upon initiation of rotation of the drawworks drum 21.

Starting with the load block 16 at its lower travel limit point 26, the operation switch 19 is set to calibrate and the calibrate feature of the position function 70*b* is initiated. Upon initiation of the calibrate mode, the "running sum" signal pulse count is set to zero. Upon initiation of movement of the drawworks drum 21, if the "first" pulse signal received from one of the two-channel inputs indicated a positive direction of rotation of the drum 21 (i.e., block 16 moving up), the running sum pulse count was accruemented by the number of positive signal pulses received. If the "first" pulse signal received was from the other of the two-channel inputs, then a negative direction of rotation of the drum 21 (i.e., block 16 moving down) was indicated, and the running sum pulse count was decremented by the number of negative signal pulses received.

When the load block 16 reached its upper travel limit point 25 of the travel range 24, the operation/mode switch 19 was taken out of calibrate and set to the run mode. This terminated the calibration feature function and saved the running sum pulse count value in memory as the "travel range pulse count." The travel range pulse count is the number of positive signal pulses accrued to reach the upper travel limit point 25 and is the pulse signal equivalent of the full scale travel range 24. In other words, the travel range pulse count is the net number of positive speed/position sensor pulses that must be received to move the hoist block 16 from the zero (or lower travel limit) position 26 to the upper travel limit position 25. A running sum pulse count that is less than zero or greater than the travel range pulse count is beyond the limit of the hoist block travel range 24.

The operation/mode switch 19 was then set to its run function and calibration of the position function was completed. Thereafter, on any subsequent initiation of movement of the drawworks drum 21, a "first" signal received from the other channel of the two-channel inputs indicated a negative direction of rotation of the drawworks 21. For position function calculation purposes, the negative direction pulse signals were used to decrement a "running sum" of all position signals. The running sum of all position signal accruements and decrements was saved in memory and provided the variable for comparison to the travel range total pulse count that allowed calculation by the microprocessor to determine the position of the hoist block 16 relative to its travel limit 24.

Speed/Momentum Control Functions

Varying operating conditions of rotational speed and load can result in large differences in momentum of the moving hoist block 16, and can cause the travel range 24 to be exceeded. To prevent this situation from occurring, the combination of speed limit weight limits functions of the software/instruction set 70 provided a degree of momentum control for the present hoist system controller 10.

Speed Function. In the preferred embodiment illustrated in FIG. 1, the present hoist system controller 10 used a sensor 12*a* comprising an optical encoder attached to the drawworks to generate speed and position data in the form of electronic pulses. The number of position pulse signals the encoder 12*a* produced (ninety-six pulses) per each revolution of the drawworks drum 21 was input into the speed control function 70*a*. The speed control function 70*a* (see FIG. 5A) utilized the number of pulses produced per unit time to accurately calculate the drawworks drum 21 rotational speed (in RPM). Rotational speed could then be converted to cable speed (taking into account the dimensions of the drawworks drum 21) and then to speed of the hoist block 16 (by taking into account the mechanical advantage of the hoist block 16 and stationary block 18 combination).

Momentum Control Function. The travel limit function 70*b* also comprised a setting for an upper and a lower "percentage of travel" set point within the established upper and lower limits 25 & 26 of the travel range 24. An RPM based on the drawworks' actual operational characteristics was determined using a tachometer to establish the normal RPM of the drawworks drum 21 under load conditions. This speed data was then entered into the software to set the maximum RPM permissible at an appropriate point short of the travel limit points 25 & 26 to initiate braking. Such appropriate RPM check points were taken as a percent of the travel range 24 approaching either travel limit point 25 or 26. Separate max RPM speed limits can be provided for both the upper speed limit set point 28 and the lower speed limit set point 27 (see FIG. 1) as determined by the ordinary skilled artisan. As an example, a lower speed limit set point 27 was set at 85% of the lower travel limit 26 and an upper speed limit set point 28 was set at 10% of upper travel limit 25. Preferably, default values for the speed limit set points 27 & 28 are hard coded into the instruction set 70 with the capability to set alternative limits using a device input means, such as a keypad 38.

In the preferred embodiment, the operator was alerted when the speed (as determined by the speed control feature) of the hoist block 16 or drawworks drum 21 exceeded the established limit at a warning point, e.g., 70% and 20% of the lower and upper travel limit points 26 & 25 respectively. This allowed the operator to manually reduce the speed prior to the hoist block 16 reaching the automatic momentum trips at 85% and 10% of the lower and upper travel limit set points 26 & 25. If a percent travel limit point is reached and the speed of the drawworks 20 is in excess of the pre-set value for that percent travel limit point, a drawworks control signal 46 is generated and sent to automatically initiate braking of the drawworks 20. This feature stopped the load block 16 at or very near the upper or lower limit.

The number of position signals received per 360° of rotation of the drawworks drum 21 was input into the microprocessor 32. Using this data and measuring the pulse rate of the position signal allowed the microprocessor 20 to calculate the rate of travel for the load hoist 16. By determining the number of pulses received per unit time, an accurate calculation of the rotational speed of the drawworks drum 21 was made. The microprocessor 32 calculated the position of the traveling block 16 based on the running sum of counts relative to the total number of counts saved during the calibration phase (see FIGS. 5B–5D). This allowed the microprocessor 32 to accurately determine and display the current position of the hoist block 16 within its travel range 24.

Load Function

The load signal system 12*b* was used to monitor the instantaneous weight load on the hoist block 16. The load signal system 12*b* utilized in the illustrated embodiments was a hydraulic pressure sensor/transducer connected to the stationary block 18 of the hoist system (see FIG. 1). The hydraulic pressure sensor 12*b* produced a voltage signal relative to the load being lifted by the traveling block 16. This signal was received by the microprocessor 32 via an I/O port 62. The load signal was proportional to the load lifted by the traveling block 16.

Figure 5E:
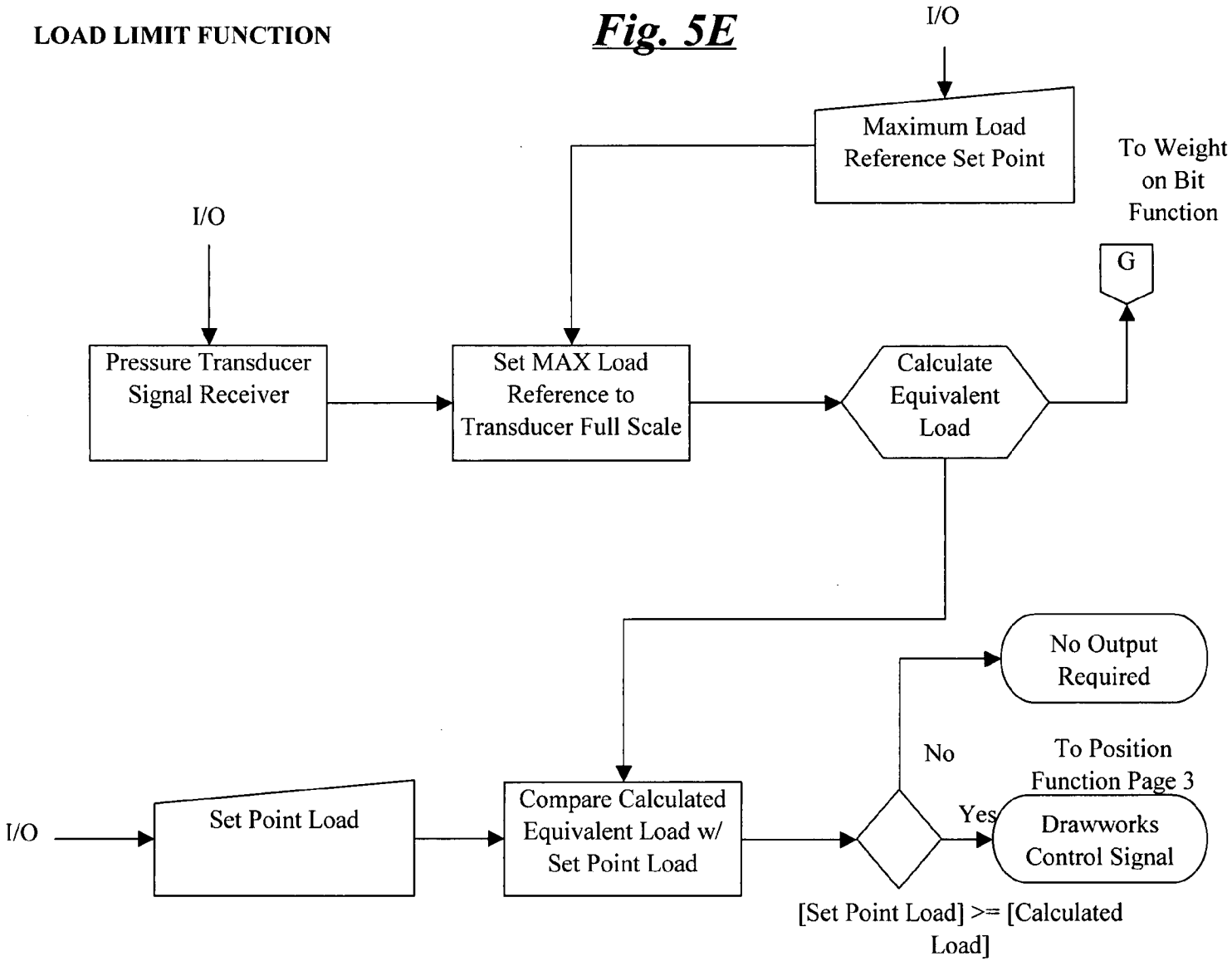
Figure 5F:
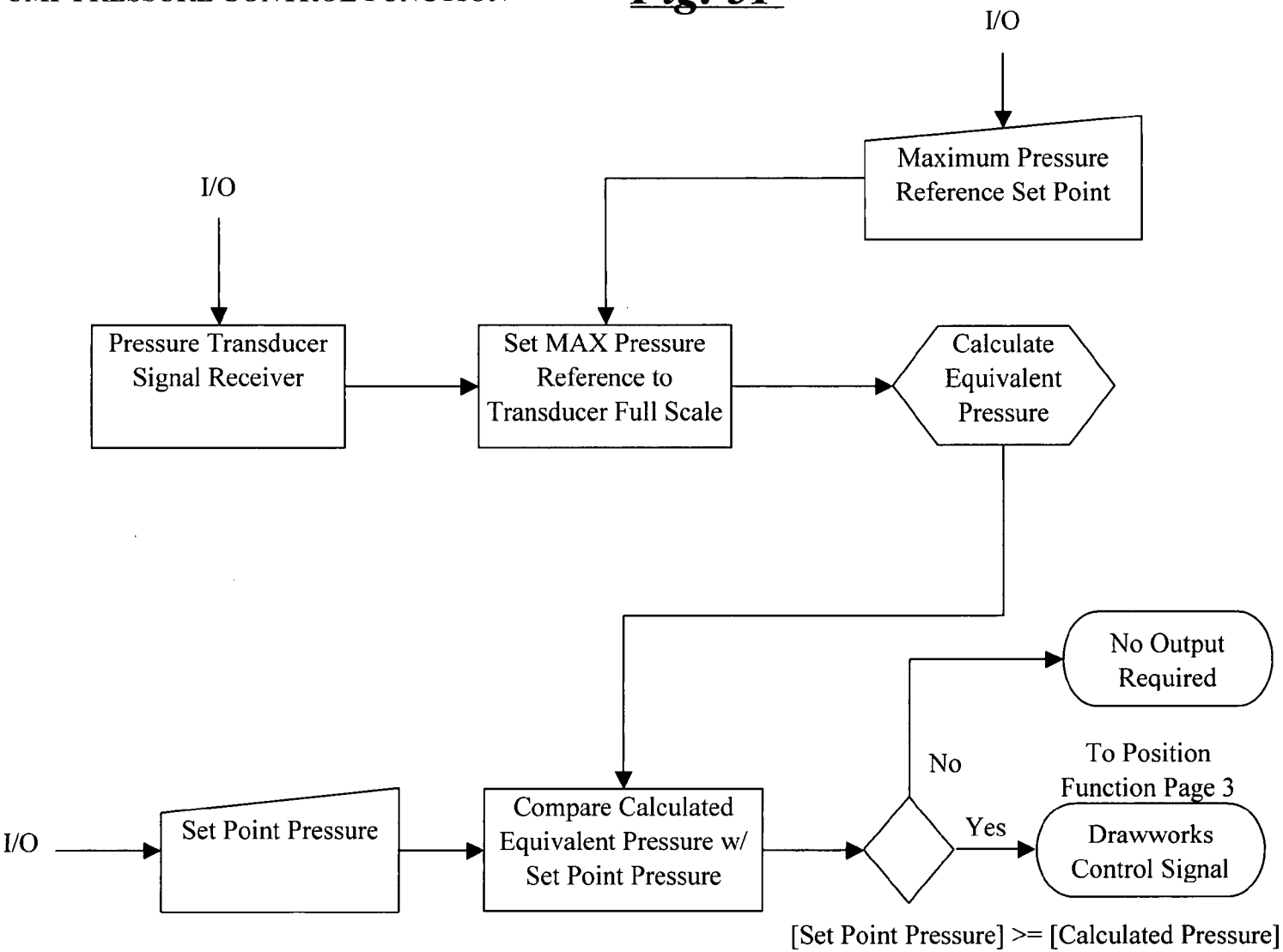

The load sensor system 12*b* function is illustrated in FIG. 5E. The maximum load capacity rating (MAX Load) for the pressure sensor 12*b* was input to the microprocessor 32 using a data entry means on the front panel 34 of the controller 10. The sensor's max load capacity rating was equivalent to the max load voltage signal output from the hydraulic pressure sensor 12*b*. The microprocessor 32 received the load voltage signals from the pressure sensor transducer 12*b* and converted them to a proportional weight equivalent of the max load capacity to determine the weight of the actual load on the hoist block 16.

A further data entry input (Set Point Load) was entered into the microprocessor 32 to set a shutdown limit on the maximum weight of an actual load on the hoist block 16. The actual load shutdown limit was chosen to avoid exceeding the load capacity both the sensor 12*b* itself and the hoist system 14. The setting for the maximum actual load weight limit was compared to the actual load weight on the hoist block 16, and if the actual load weight exceeded the maximum actual load limit, a shutdown signal was sent to the drawworks 20. The maximum load, the actual hoist block weight, and shutdown weight limit were all displayed on the display panel 34. Load control and warning functions are provided by the microprocessor 32 via its I/O ports 62 to prevent the load lifted from exceeding the set weight limit.

Intermediate Travel Range Function

Because the hoist block 16 of a hoist system 14 can have accessory devices connected to it, which accessory devices may further limit the primary travel range 24 of the hoist block 16, an optional intermediate travel range 24*a* (see FIG. 1) may be entered into the instruction set 70 relative to the primary travel range 24. The intermediate travel range is an alternative set of upper and lower travel limit points 25*a* and 26*a* within the primary travel range 24. When the intermediate travel range function is activated, the limits of the intermediate travel range 24*a* become the functional limits of the upper and lower limits of the hoist block's travel.

Weight-On-Bit Function

The Weight-on-Bit function (see FIG. 6) utilizes an activation input from the operator via a device input means 40 on front panel 34 the housing 30 to signal when the total load on the hoist block 16 is being lifted. When the load is partially or fully supported in the well bore, then the actual load weight displayed at the controller's front panel 34 is the part of the total weight that the hoist block 16 is supporting. By determining the difference between the total load and the actual weight reading, the weight on the drill bit in the well bore is calculated.

By using a separate data input, the operator can set a limit for the desired operational value for the weight on the drill bit to control the drilling rate. When the calculated value for the weight on the bit equals the set limit value for the weight in the bit, an output control signal is sent to the drawworks 20 to brake the hoist system 14 and thereby controlling the weight applied to the drill bit.

Penetration Rate Function

The hoist system 14 used to lift the loads on a drill rig typically uses a number of pulleys on the stationary block 18 and the moveable hoist block 16 to provide the mechanical advantage necessary for the heavy loads lifted. This can result in up to 10 pairs of pulleys each on both the stationary and movable blocks 18 & 16. This would require 20 feet of cable to move the main block 1 foot. The cable associated with the pairs of pulleys is called parts of line.

The cable hoist drum 21 on the drawworks 20 has a fixed diameter. However, the drum's effective diameter changes as the cable is wound onto the drum 21 forming additional layers of cable which add to the drum's diameter. At each layer of cable on the hoist drum 21, the effective diameter of the drum 21 increases by approximately twice the diameter of the cable. For example, if the wire rope diameter is 1½", the effective diameter of the drum will increase by 3" for each layer on the drum 21. This results in a change in number of feet of cable movement per revolution of the cable drum 21 at each layer of cable laid on the drum. Typically, the cable is partially wound on the bare drum when the block is at the lower limit. When the block is raised towards the upper limit, the cable completes the first layer on the bare drum then forms a second layer across the drum on top of the first layer of cable. When the block reaches the upper limit, the cable has partially formed a third layer on the hoist drum.

If the encoder 12*a* produces 96 pulses per revolution of the drawworks drum 21, we could calculate feet per pulse for each circumference based on a bare drum diameter of 24 inch and 1.5 inch diameter cable. These values would then be: 0.065449 feet per pulse for circumference one; 0.073631 feet per pulse for circumference two; and 0.081812 feet per pulse for circumference three. In order to accurately calculate the position of the block, it must be determined which layer the cable is on and the associated feet per pulse factor. This determination was made in a calibration process (see FIGS. 7A–7C) by moving the hoist block 16 to the lower limit 26. The operation/mode switch 19 was turned to calibrate and the initial pulse signal counts for the first layer of cable on the drum 21 as the hoist block 16 is raised.

A first circumference signal is sent to the microprocessor when the cable 22 completes the first layer of the drum 21. This gives the number of pulses from the lower block limit 26 necessary to complete this first circumference, and a way to calculate cable travel in feet between the lower limit and the point when the cable fills the first layer on the hoist drum 21. A second circumference signal is sent to the microprocessor when the cable 22 completes the second layer of the drum 21, yielding the pulse count from the start of the second layer to the end of the second drum layer. The third layer pulse count, which is a partial layer, would also be determined when the mode switch 19 is moved out of the calibrate position to the run position. The pulse count range for each layer (0 to x=first layer; x to y=second layer; and y to z=third layer) would be the basis for determining when the change in factor for calculating feet per pulse would occur. Using the above we could calculate the position of the hoist block 16 in feet at any position between the lower limit 26 and the upper limit 25 of its travel range 24.

Ton-Mile Function

The ton-mile function is a means to monitor cable wear relative to a presumed cable life expectancy. The parameters the ton-mile function are: total ton-mile allowable; and cumulated ton-miles. The ton-mile function requires weight-on-bit data and penetration rate data. The ton-mile utilized the calculated feet of cable travel times cable load divided by 5280 times 2000. Calculating cable travel requires a cumulative total of all encoder signal pulse counts (both positive and negative), as the ton-mile is based on total cable movement in both directions. An alarm indicates when the calculated ton-mile value reaches some predetermined percentage of the presumed cable life expectancy. The percentage value is set in the software as a variable to allow adjustment for the specific cable's wear parameters.

MUD Pump Pressure Function

The present hoist system controller 10 is capable of integrating a variety of drilling functions with control of the hoist system's drawworks 20. For example, a drilling fluids (MUD) pump pressure sensor signal 12*c* can be used to monitor the instantaneous pump pressure of a drilling rig's MUD pump (not shown). When drilling, drilling fluid is pumped from the surface through the hollow drill pipe down to the drill bit, using a high pressure positive displacement pump. This drilling fluid is required to flush the cuttings from the drill bit and circulate these cuttings to the surface in the well bore annulus. When the drill bit is above the formation to be drilled (say two feet above the bottom of the well bore face), the pump discharge pressure will be approximately equal to the weight of the fluid column in the well bore plus some amount of friction in order to circulate the fluid from the surface and back into the drill pipe. This pressure will increase as the drill bit engages the formation, with the pressure increase at least in part a function of how much force is applied to the drill bit as it engages the formation.

The ability to set and limit the amount of differential pump pressure due to the drill bit force on the formation being drilled can be used to control drill rate by applying the drawworks brake when the set pressure value is equal to the pump discharge pressure. The MUD pump pressure sensor system 12*c* function is illustrated in FIG. 5E. The maximum pressure capacity rating (MAX Pressure) for the pump pressure sensor 12*c* was input to the microprocessor 32 using a data entry means on the front panel 34 of the controller 10. The sensor's max pressure capacity rating was equivalent to the max load voltage signal output from the pump pressure sensor 12*c*. The microprocessor 32 received the load voltage signals from the pressure sensor transducer 12*b* and converted them to a proportional weight equivalent of the max pump pressure capacity to determine the actual pressure load on the MUD pump.

A further data entry input (Set Point Pressure) was entered into the microprocessor 32 to set a pump pressure shutdown limit on the pump's actual pressure load. The actual load shutdown limit was chosen to avoid exceeding the load capacity the MUD pump. The setting for the maximum pressure limit was compared to the actual pump pressure, and if the actual pump pressure exceeded the maximum pressure limit, a shutdown signal was sent to the drawworks 20. The maximum MUD pump pressure, the actual pump pressure, and shutdown pressure limit were all displayed on the display panel 34.

The system logic of the present automatic hoist travel limiter 10 may be further clarified by reference to FIGS. 9A to 9D.

While the above description contains many specifics, these should not be construed as limitations on the scope of the invention, but rather as exemplifications of one or another preferred embodiment thereof Many other variations are possible, which would be obvious to one of ordinary skill in the art. Accordingly, the scope of the invention should be determined by the scope of the appended claims and their equivalents, and not just by the embodiments.

What is claimed is:

1. A multi-function cable hoist system controller comprising:

a housing for containing and mounting a microprocessor and input and output systems;

a microprocessor having a CPU, data storage means, memory means, and I/O ports;

an instruction set digitally stored in the data storage means of the microprocessor, the instruction set enabling the microprocessor to process inputs and to generate outputs to accomplish the functions of the controller, wherein the instruction set comprises a position control function for determining position of a hoist block of said hoist system within a travel range, a speed control function for determining the rate of vertical displacement of the hoist block, and a load limit function for determining an instantaneous mass load on the hoist block;

an external signal input system in communication with the I/O ports of the microprocessor, the external signal input system for receiving signals from detectors and sensors external to the housing;

a device input system mounted on the housing and in communication with the I/O ports of the microprocessor, the device input system for entering data and instructions into the microprocessor;

a device output system mounted on the housing and in communication with the I/O ports of the microprocessor, the output system for presenting output signals from the microprocessor at the controller; and an output signal system in communication with the I/O ports of the microprocessor, the output signal system for communicating control signals to said hoist system.

2. The multi-function cable hoist system controller of claim 1, wherein the instruction set comprises a position control function for determining position of a hoist block of said hoist system within a travel range, and a speed control function for determining the rate of vertical displacement of the hoist block.

3. The instruction set of claim 1 further comprising at least one function selected from the group consisting of a penetration rate function for monitoring the downward movement of the hoist block during drilling, a weight-on-bit function for monitoring the downward force on a drill bit suspended downhole from said hoist system, a ton-mile function for monitoring cable wear of the hoist system, and a pump pressure function.

4. The multi-function cable hoist system controller of claim 1, wherein the external signal input system includes a mass measurement input signal, a distance measurement input signal and a relative time input signal.

5. The multi-function cable hoist system controller of claim 4, wherein the mass measurement input signal is received from a load sensor measuring mass of a load on the hoist block of the hoist system.

6. The multi-function cable hoist system controller of claim 4, wherein the distance measurement input signal is received from a cable travel measuring sensor.

7. The multi-function cable hoist system controller of claim 4, wherein the relative time input signal is received from a rate sensor.

8. The multi-function cable hoist system controller of claim 1, wherein the device input system mounted on the housing comprises manual means for entering data and instructions into the microprocessor.

9. The multi-function cable hoist system controller of claim 1, wherein the device input system mounted an the housing comprises electronic means for entering data and instructions into the microprocessor.

10. The multi-function cable hoist system controller of claim 1, wherein the device output system mourned on the housing comprises at least one display device for presenting output signals from the microprocessor at the controller.

11. The multi-function cable hoist system controller of claim 1, wherein the device output system mounted on the housing comprises at least one audio device for presenting output signals from the microprocessor at the controller.

12. The multi-function cable hoist system controller of claim 1, wherein the output signal system communicates control signals to the drawworks of said hoist system.

13. The multi-function cable hoist system controller of claim 1, wherein the output signal system communicates a braking signal to the drawworks of said hoist system.

14. The multi-function cable hoist system controller of claim 1, wherein the output signal system communicates a drum rotation rate control signal to the drawworks of said hoist system.

* * * * *